US007569762B2

(12) United States Patent
Baum, Jr. et al.

(10) Patent No.: US 7,569,762 B2
(45) Date of Patent: Aug. 4, 2009

(54) RF-BASED DYNAMIC REMOTE CONTROL FOR AUDIO EFFECTS DEVICES OR THE LIKE

(75) Inventors: Robert Thomas Baum, Jr., Gaithersburg, MD (US); James Edward Curry, Wake Forest, NC (US); Jeffrey Ian Winter, Rockville, MD (US)

(73) Assignee: Xpresense LLC, Rockville, MD (US)

( * ) Notice: Subject to any disclaimer, the term of this patent is extended or adjusted under 35 U.S.C. 154(b) by 0 days.

(21) Appl. No.: 11/700,862

(22) Filed: Feb. 1, 2007

(65) Prior Publication Data

US 2007/0175321 A1 Aug. 2, 2007

Related U.S. Application Data

(60) Provisional application No. 60/764,368, filed on Feb. 2, 2006.

(51) Int. Cl.
*G10H 1/18* (2006.01)

(52) U.S. Cl. ..... 84/626; 84/615

(58) Field of Classification Search ..... 84/615–620, 84/653–656, 626, 662; 324/519, 658, 661, 324/686

See application file for complete search history.

(56) References Cited

U.S. PATENT DOCUMENTS 3,704,339 A * 11/1972 Niinomi ..... 84/687
4,235,144 A * 11/1980 Lubow et al. ..... 84/737
4,487,057 A * 12/1984 Lutz ..... 73/40.5 R
4,503,746 A 3/1985 Kakehashi
4,526,078 A 7/1985 Chadabe
4,627,324 A * 12/1986 Zwosta ..... 84/694
4,852,443 A * 8/1989 Duncan et al. ..... 84/733
4,986,136 A * 1/1991 Brunner et al. ..... 73/862.046

(Continued)

FOREIGN PATENT DOCUMENTS

WO WO 89/02635 3/1989

(Continued)

OTHER PUBLICATIONS

Alesis AirFX. http://remixmag.com/mag/remix_alesis_airfx_2/.*

(Continued)

*Primary Examiner*—David S. Warren
(74) *Attorney, Agent, or Firm*—McDermott Will & Emery LLP

(57) ABSTRACT

Systems and methods are disclosed for providing wireless remote control of devices, where the sensing/transmitting device is worn by, or affixed to, the operator, and responds in real-time to position or movements. The technology enables the operator to control remote devices, even while the operator is engaged in other activities. For an exemplary musical performance application, the remote control apparatus may take the form of a normal sized ring worn on a finger of a hand that the musician uses to play a musical instrument. The ring senses position or movement, e.g. of one or more fingers of the hand. In the examples, the remote control apparatus uses a capacitive measurement technique to measure an electrical field generated in the vicinity of the hand indicative of position. The musician or operator can finely control a device with the system, e.g. to provide nuanced control of audio effects during the performance.

18 Claims, 13 Drawing Sheets

Preferred Mode of Operation, with exemplary performing accessory, open hand

Preferred Mode of Operation, with exemplary performing accessory, closed finger

U.S. PATENT DOCUMENTS 5,029,508 A * 7/1991 Suzuki et al. ..... 84/616
5,046,394 A 9/1991 Suzuki et al.
5,147,969 A * 9/1992 Hiyoshi et al. ..... 84/600
5,166,462 A * 11/1992 Suzuki et al. ..... 84/600
5,166,463 A * 11/1992 Weber ..... 84/600
5,192,823 A * 3/1993 Suzuki et al. ..... 84/600
5,216,193 A * 6/1993 Masubuchi ..... 84/600
5,245,128 A 9/1993 Araiza
5,290,964 A * 3/1994 Hiyoshi et al. ..... 84/600
5,300,730 A * 4/1994 Ekhaus ..... 84/734
5,440,070 A * 8/1995 Okamoto et al. ..... 84/600
5,449,002 A * 9/1995 Goldman ..... 600/592
5,463,388 A * 10/1995 Boie et al. ..... 341/33
5,478,969 A 12/1995 Cardey, III et al.
5,561,257 A 10/1996 Cardey, III et al.
5,581,484 A * 12/1996 Prince ..... 702/150
5,625,294 A * 4/1997 Kawai et al. ..... 324/668
5,700,966 A 12/1997 LaMarra
5,775,332 A * 7/1998 Goldman ..... 600/587
5,826,178 A 10/1998 Owen
5,832,296 A * 11/1998 Wang et al. ..... 710/3
5,965,954 A 10/1999 Johnson et al.
6,114,862 A * 9/2000 Tartagni et al. ..... 324/662
6,222,522 B1 * 4/2001 Mathews et al. ..... 345/156
6,284,962 B1 * 9/2001 Gardner et al. ..... 84/600
6,348,862 B1 2/2002 McDonnell et al.
6,360,615 B1 * 3/2002 Smela ..... 73/862.474
6,380,923 B1 * 4/2002 Fukumoto et al. ..... 345/156
6,437,583 B1 * 8/2002 Tartagni et al. ..... 324/687
6,563,468 B2 5/2003 Hill et al.
6,670,884 B1 12/2003 Tett
6,681,638 B2 * 1/2004 Kazerooni et al. ..... 73/760
6,743,164 B2 * 6/2004 Airaudi et al. ..... 600/27
6,778,380 B2 8/2004 Murray, Jr.
6,838,887 B2 * 1/2005 Denen et al. ..... 324/686
6,861,582 B2 3/2005 Street
6,878,870 B2 * 4/2005 Aldridge ..... 84/733
6,909,420 B1 * 6/2005 Nicolas et al. ..... 345/156
6,946,592 B1 * 9/2005 Chick ..... 84/322
6,995,670 B2 * 2/2006 Wadlow et al. ..... 340/562
7,042,814 B2 * 5/2006 Yamada et al. ..... 369/30.26
7,099,496 B2 * 8/2006 Benkley, III ..... 382/124
7,109,726 B2 * 9/2006 van Berkel ..... 324/661
7,119,551 B2 * 10/2006 Burdick ..... 324/658
7,129,712 B1 * 10/2006 Drost et al. ..... 324/658
7,135,630 B2 * 11/2006 Maruhashi et al. ..... 84/411 P
7,146,024 B2 * 12/2006 Benkley, III ..... 382/107
7,148,704 B2 * 12/2006 Philipp ..... 324/686
7,183,480 B2 * 2/2007 Nishitani et al. ..... 84/615
7,339,107 B2 3/2008 Remignanti
7,375,536 B2 * 5/2008 Supper et al. ..... 324/661
7,394,731 B2 * 7/2008 Yamada et al. ..... 369/30.27
2002/0005108 A1 1/2002 Ludwig
2002/0075163 A1 6/2002 Smith et al.
2003/0080755 A1 * 5/2003 Kobayashi ..... 324/658
2003/0137796 A1 7/2003 Bulucea
2003/0196542 A1 10/2003 Harrison, Jr.
2004/0017210 A1 * 1/2004 Johnson et al. ..... 324/661
2004/0113634 A1 * 6/2004 Stanley et al. ..... 324/661
2004/0130335 A1 * 7/2004 Shimizu et al. ..... 324/661
2004/0160231 A1 8/2004 Iwasaki et al.
2004/0182230 A1 * 9/2004 Vlant et al. ..... 84/662
2004/0210166 A1 * 10/2004 Soh et al. ..... 600/595
2004/0251918 A1 * 12/2004 Cehelnik ..... 324/663
2005/0172734 A1 8/2005 Alsio et al.
2006/0049835 A1 * 3/2006 Burdick ..... 324/658
2007/0088664 A1 4/2007 Nakano et al.
2007/0169615 A1 7/2007 Chidlaw et al.
2007/0175322 A1 8/2007 Baum, Jr. et al.
2007/0182545 A1 8/2007 Baum et al.
2008/0100522 A1 * 5/2008 Inaba et al. ..... 343/713
2008/0116904 A1 5/2008 Reynolds et al.

FOREIGN PATENT DOCUMENTS

WO WO 2007/009224 A2 8/2007
WO WO 2007/092238 A2 8/2007
WO WO 2007/092239 A2 8/2007

OTHER PUBLICATIONS

International Search Report and Written Opinion of the International Searching Authority, issued in International Application No. PCT/US07/02696, dated on Mar. 3, 2008.
International Search Report and Written Opinion of the International Searching Authority issued in International Patent Application No. PCT/US07/02697 dated on Jan. 15, 2008.
Rekimoto "Gesture Wrist and Gesture Pad: Unobtrusive Wearable Interactive Devices" International Symposium on Wearable Computers, ISWC 2001 pp. 1-7 http://www.csl.sony.co.jp/person/rekimoto.html.
International Preliminary Report on Patentability, dated on Aug. 14, 2008, and Written Opinion of the International Searching Authority issued in International Patent Application No. PCT/US07/02697 dated on Jan. 15, 2008.
International Preliminary Report on Patentability, dated on Aug. 14, 2008, and Written Opinion of the International Searching Authority issued in International Patent Application No. PCT/US07/02696 dated on Mar. 3, 2008.
International Preliminary Report on Patentability, dated on Aug. 14, 2008 and Written Opinion of the International Searching Authority issued in International Patent Application No. PCT/US07/02695dated on Oct. 19, 2007.
International Search Report, issued in International Patent Application No. PCT/US07/02695, dated on Oct. 19, 2007.
United States Office Action issued in U.S. Appl. No. 11/700,863, dated Apr. 20, 2009.

* cited by examiner

Block diagram of wireless remote control system

Preferred Mode of Operation, with exemplary performing accessory, closed finger

Preferred Mode of Operation, with exemplary performing accessory, open hand

High-level circuit diagram of all the electronic systems in the remote control apparatus Diagram of State control of the loop structure assembly via a microcontroller Functional subsystems of the remote control apparatus Example circuit embodiment States of Exemplary Circuit Embodiment Exemplary Capacitive Sensing when employing a capacitive shield Field Lines of Exemplary Capacitive Sensing
(Field lines between the inner (center) conductor and outer (shield conductor) are not shown.)

Cross-section of coaxial loop structure

Front view of the loop structure assembly

Side view of remote sensor

Bottom view of remote control apparatus

Operation features on the underside of the ring's band

Messaging Scheme

Message framing scheme

Notes: Offsets are in microseconds (μs)
V means 3-bit encoded binary value

Pulse Width Modulation Scheme

Wave form with multiple intended control signals

Sampling a wave form

Charge-based mechanism of programming the Remote control apparatus

Apparatus for recharging the battery of the remote control apparatus

Schematic of Internal Grounding Complex

Example of Inner Band configuration

Details of the Inner Band Assembly

High-Level Functional Block Diagram of Exemplary Base Unit

Exemplary Reception Process of the Base (Receive) Unit

Exemplary Base (Receive) Unit

RF-BASED DYNAMIC REMOTE CONTROL FOR AUDIO EFFECTS DEVICES OR THE LIKE

RELATED APPLICATIONS

This application claims the benefit of U.S. Provisional Application No. 60/764,368 Filed Feb. 2, 2006 entitled "RF-Based Dynamic Remote Controller for Audio Effects Devices," the disclosure of which also is entirely incorporated herein by reference.

TECHNICAL FIELD

The present subject matter concerns methods, systems and system components that performing artists or the like may use for wireless remote control, e.g. of electronic audio effects equipment.

BACKGROUND

The description of art in this section is not, and should not be interpreted to be, an admission that such art is prior art to the concepts discussed herein. Conventional electronic audio effects and output devices are introduced below, for the reader's convenience. Then, the concept of wireless remote control is explained in the subsequent section. Finally, some known attempts to provide remote control of audio effects are discussed, along with their relative pros and cons.

Conventional Audio Effects

The following definitions help to provide context for a preferred application of the remote sensing and control technology, that is to say, for control of electronic audio effects devices.

Effects Units

Today, there is a variety of analog and digital signal processing (DSP)-based audio effects that are available for musicians to apply to the sound of their instruments. These include reverb, delays, echo, flangers, phasors, Wah-Wah, pitch shifters, harmonizors, distortion, and others. These effects come packaged in various forms, such as Stomp Boxes (single effects units with built in foot operated bypass switches), rack-mounted multi-effects units, and floor-board multi-effects units. Guitar amplifiers frequently have an optional footswitch to switch amp channels between clean and overdrive. Some amplifiers such as those used for guitars come with built in effects.

Preset

A preset is a stored configuration of operating parameters of a musical electronics device, which the operator may recall for future use. Typically, a device has a built-in, factory-supplied collection of presets, and allows the operator to define and store a user-defined collection, as well. For example, in a multi-effect unit, Preset 1 might apply reverb to the sound; Preset 2 might apply the Wah-Wah effect.

Foot Switches

A popular means of turning an effect off (audio bypass) and on is to use a footswitch. Stomp Boxes come with a built-in foot switch for this purpose. Multi-effect units have multiple footswitches for switching more than one effect. Some effect units have one or more ¼-inch phone jack inputs that accept a footswitch. A Foot Switch can operate in one of two ways—momentary and toggle. A momentary switch closes an electrical connection when depressed, and opens the connection when released. A toggle switch toggles between open and closed with each subsequent depression.

Expression Pedals

Many effects have attributes that can be modulated through an expression controller. Wah-Wah effect, volume swells, pitch shift, and delay are examples. Expression controllers are available in several types, including ribbon controllers, joysticks, and expression pedals. Expression pedals are most commonly comprised of an analog potentiometer mounted to a foot-operated treadle. Some use optical electronics, rather than potentiometers. Moving the treadle with the foot changes the desired attribute of an effect. The connection between the pedal and the effect unit may be an analog ¼-inch phone cord or a MIDI connection.

MIDI (Musical Instrument Digital Interface)

Rather than representing musical sound directly, MIDI transmits information about how music is produced. The command set includes note-on, note-off, key velocity, pitch bend, and other methods of controlling a synthesizer. It has also come to be used as a means of controlling musical effects using a subset of the MIDI message set, including Program Change messages and Continuous Controller messages (see below).

MIDI Program Change Message

A Program Change Message is one of the MIDI commands that can be used to control effects. A Program Change message can be used for many purposes including the selection of a Preset on a multi-effect unit or switching amplifier channels on a guitar amplifier.

MIDI Continuous Controller Message

A Continuous Controller Message (CC Message) is another MIDI command that can be used for the control of effects. The message format includes a Controller Number and Expression Value. It is used to pass expression controller values to effect units for effects control. One example is a potentiometer-based Expression Pedal connected to a microprocessor that converts the potentiometer values into MIDI CC values, and then sends them to an effect unit to control effects in the same way that a directly connected expression pedal would.

Remote Control

Remote control is a means for controlling one or more devices using a separate device (remote controller) that is remotely located. Remote control requires that the devices being controlled have a means for receiving, understanding, and executing the control signals from the remote controller. In today's market for consumer electronics, a remote control feature—specifically wireless remote control is standard for all manner of audio and video products, including PC-based platforms. Remote control is also a common, if not standard, feature on other consumer goods, from ceiling fans to children's toys.

A remote controller is a device that emulates the control features of one or more other devices, such that an operator can control the other device(s) from a remote location.

A wireless remote controller is a remote controller that does not require any physical connection between it and any other device. It typically operates using radio frequency (RF) or infrared radiation (IR), and requires that the devices being controlled have a compatible receive mechanism. Other types of emanations, including ultrasound, may also be used.

Known Ideas for Providing Remote Control of Audio Effects Devices

Some related art teaches modifications to the instrument such as an on-guitar tilt sensor or digital compass (e.g., U.S. Pat. No. 6,861,582 and U.S. Patent Application No. 20030196542). These teachings suffer from a lack of sensitivity, require modification of the pre-owned instrument, and require body gyrations that limit the expressiveness and can interfere with playing technique.

Other related art (e.g., U.S. Pat. Nos. 5,245,128 and 5,700,966) teach guitar mounted switches, which are limited to the on/off control of effects and are not easily and seamlessly integrated into playing technique.

Other related art teaches the application of sensor electronics to a pick (pluckstrum) to detect the bending of the pick or contact of the pick with a string on the musical instrument. Examples are U.S. Pat. Nos. 5,300,730 and 4,235,144. These teachings likely suffer from implementation difficulties relating to size and difficulty of maintaining the desired grip and exposure of the pick to the strings as required by the playing technique.

Other related art (U.S. Pat. Nos. 4,503,746, 5,561,257 and 5,478,969) teach the application of pressure sensors to a guitar strap such that tugging on the strap generates effect control signals. These teachings suffer from a lack of sensitivity and require body gyrations that limit the expressiveness and can interfere with playing technique.

U.S. Pat. No. 5,046,394 teaches the detection of finger bending using a light emitter/detector means. This teaching suffers from implementation issues relating to the power requirements of such sensors and the impact on the portability of the device.

U.S. Patent Application No. 20020005108 teaches the use of at least one data array in combination with pattern recognition to detect gestures for the control of effects. This teaching suffers from implementation issues relating to the processing requirements and delays associated with pattern recognition.

A need exists for improvements over the above discussed art, to provide wireless remote control for devices such as conventional audio effects devices or the like, wherein such a remote control which supports expressive and nuanced remote control operation by the operator. Attendant needs exist for methods, systems and system elements for providing such control.

SUMMARY

The technologies disclosed herein provide improvement over some or all of the art discussed above and address one or more of the above-discussed needs, by providing an enhanced wireless remote control system and/or enhanced methods for wireless remote control.

For example, a disclosed method involves generating an electrical field at a location on a body of an operator and sensing the electrical field at the location as an indication of position of a part of the body of the operator. A signal representing the result of the sensing of the electrical field is wirelessly transmitted. Upon reception of the wireless signal, the method entails generating a control signal for output to a controlled device, based on the electrical field sensing result represented by the received signal.

In the example, the field generation and sensing are performed at a sensor plate located on a part of the operator's body. In a ring configured control apparatus, the plate is on a finger of a hand of the operator. A charge transfer technique may be used to measure charge as a representation of capacitance at the plate and thus to sense the field, and repeated capacitive measurements regarding the field provide an indication of the field over time and thus movement (changes of position) of a body part, e.g. one or more fingers of the hand in proximity to the sensor plate.

A parameter of the transmit signal indicates the information related to the results of the sensing of the electrical field. The example transmits messages, and the intervals between message transmissions vary in duration responsive to the field responsive measurements. The inter-message duration may relate to a capacitive measurement, although in a specific example, the duration relates to the time required to complete each capacitive measurement, e.g. to take a capacitance measurement or to transfer sufficient charge to reach a reference level. During the intervals between messages (while a measurement is being taken), the transmitter is inactive and draws little or no power. The wireless remote control apparatus may also power-down into a sleep mode when not in use, e.g. upon detection of little or no change in capacitive measurements over some defined period.

The detailed description herein and the accompanying drawings also disclose a wireless remote control system. The system includes a remote control apparatus configured for wearing on or attachment to a location on a body of an operator. That apparatus includes a sensor plate, circuitry, and a transmitter. The circuitry applies a signal to the sensor plate, to generate an electrical field at the location on the body of the operator. The circuitry also senses the electrical field at the location. The sensed field indicates relative position of a part of the body of the operator, and the sensing results provide an effective position responsive measurement. The transmitter wirelessly transmits a signal representing the result of the sensing of the electrical field. The system also includes a base unit, having a receiver for receiving the wirelessly transmitted signal, and a processor coupled to the receiver, for generating a control signal, based on the electrical field sensing result as indicated in the received signal.

The system may be used for a variety of remote control applications. One application discussed in detail relates to control of an audio effects device during a musical performance, by a performing artist. For that application, for example, the base unit includes an output interface for an audio effects device, such as a Musical Instrument Digital Interface (MIDI) type output interface, an expression pedal output interface or an emulated footswitch relay.

The disclosure here also encompasses a method of providing wireless remote control. During physical manipulation of an object by an operator, but not directly related to the object manipulation, position or motion of a part of the operator's body engaged in the manipulation of the object over a substantially continuous range of possible positions of the part of the operator's body is sensed in real-time. The method involves transmitting a wireless signal from a location on the operator's body, where the wireless signal carries information responsive to the real-time sensing of the position or motion of the part of the operator's body. The wireless signal is received at a location remote from the operator, and a control signal is generated for a controlled device, based on the information carried in the received wireless signal.

In a musical performance example, the operator is the musician, the object is a musical instrument, and the manipulation involves the musician playing the musical instrument. The part of the operator's body is one or more fingers on a hand of the musician, and the method is implemented while the musician is using the hand in the playing of the musical instrument.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 4*a* shows an open (extended) finger position, while FIG. 4*b* shows a closed (flexed) finger position.

FIG. 9*a* illustrates the active components on the underside of the ring's band, where the finger passes through.

DETAILED DESCRIPTION

Figure 1:
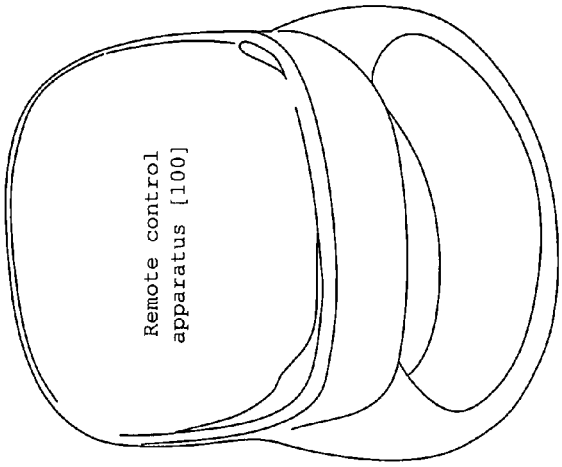
FIG. 1 shows an exterior view of wearable ring, as an example, of the remote control device.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

The present teachings encompass methods and apparatuses and components thereof for providing remote control, for example, for control of electronic audio effects devices or the like. In the examples, the control capabilities are such that the effective remote control is characterized as continuous, wireless, non-obstructive, dynamically responsive to performance techniques, agile, non-linear, and responsive to any close object that might alter the capacitance at the sensor plate located on the remote control apparatus.

A general objective of the exemplary equipment and operations discussed below relates to implementing a remote control system for devices such as conventional audio effects devices or the like, that supports the introduction of new, expressive, and nuanced means of remote control.

Further and related objectives, for example for musical performance applications, to the general objective are as follows:

a) Do so continuously, without requiring explicit invocation from an operator. Further, do so in a manner that enables the wearer to operate the remote control without deviating from the natural performing style, without interrupting or delaying the performance, and without activation from another party.

b) Do so without obstructing the performance of the wearer. Moreover, do so in a manner that enables the performer to travel about the staging area in an untethered manner. Further still, do so in a manner that does not require a line of sight between it and a receiving unit.

c) With respect to the preceding objective, provide a radius (range) that is suitable for musical performances, such that performers may travel about the staging area without concern for proximity to their gear.

d) Do so in a manner that minimizes preventive and corrective maintenance.

e) Further, to partially satisfy the above objectives, do so in a monolithic structure that does not involve customary physical controls, which might distract the performer or otherwise detract from the performance.

f) Do so in a manner that dynamically responds to the performance techniques of the operator (performer). Further, do so in a manner that provides real-time response, such that there is no humanly perceptible jitter or latency in the control signals.

g) Further, to partially satisfy the above objectives do so in a focused manner that is most sensitive to movements of the fingers, thus allowing finer, more rapid and more coordinated control. Still further, do so by making use of a sensing technique that is less susceptible to outside interference than other potential solutions.

h) Do so in a manner that allows the recognition of operator-defined behavioral expressive signatures, and responds to those signatures in the operator-specified manner.

i) Do so without modifying the instrument or the performance in any way.

j) Do so in a manner that allows each of a multiplicity of performers to concurrently use a dedicated instance of the remote control apparatus, with fidelity, and in a mutually unaffecting manner.

k) Do so in a manner that allows the performer to use the device continuously for periods that meet or exceed the duration of a typical musical performance.

l) Do so in a manner that allows the performer to control effects on a note-by-note basis, as well as at the beginning or end of a sequence of notes or actions.

Some or all of the above performance objectives may be applicable in the context of a variety of other remote control applications for the technologies discussed herein.

Another related objective of the disclosed implementations is to provide a parameterized means for the operator to configure the operation of the remote control dynamic remote control device. Further, provide the ability for the operator to define sophisticated behavioral signatures, and map those signatures to specified action sequences.

Another related objective of the disclosed implementations is to provide a technique enabling modernizing or enhancing of remote control device or system functions, through program updates.

Aspects of the technology disclosed herein relate to unique apparatus and architectures and components or steps thereof, for providing remote control, e.g. control of audio effects devices or the like, in a form factor small enough for placement on a hand or other location local to the operator.

In the examples disclosed, the control device may be worn on the playing hand of a musician, although for performance or other applications it may be desirable to mount the remote control device on or adjacent to other parts of the body. In the hand mounted implementation for performance applications, the exemplary device allows for detection of subtle hand movements, does not hinder the performance, provides wireless control, enables the performer to travel about the staging area without concern for proximity to supporting gear, maintains sensor sensitivity sufficient to provide nuanced control, conserves battery life for periods exceeding a typical performance, and provides real-time response (meaning there will be no humanly perceptible latency or jitter caused by the control signals issued by the remote control). The device need not be directly activated by the performer, e.g. there is no need for the performer to touch a button, flip a switch, move a slider or pedal, or the like.

A related aspect and advantage of the exemplary control device is that it provides a means of remote control that may correlate to the expressive behaviors of the performer. The disclosed control device achieves this through a technique of sensing capacitance between a sensor portion of the remote control and its ambient environment such as the performer's skin. An example provides a remote control apparatus in a form that enables use in a variety of shapes, dictated by the intended application, such that the capacitive sensing is limited to regions of interest relative to the placement. In the form of a finger ring it is thus in a position to be continually responsive to the movements of the fingers, particularly degrees of bending and extension of the wearing finger. However, the remote control is not limited to a ring. The remote control device can be readily adapted into other form factors and/of for sensing the capacitance relative to other parts of the body or objects.

Other aspects of the disclosed technology relate to unique methods and architectures for supporting a multiplicity of such remote control apparatus in the same musical performance.

With that general outline of the subject matter to be discussed by way of example below, reference now is made in detail to the examples illustrated in the accompanying drawings.

The wireless remote control apparatus is worn, mounted or otherwise attached at a location on the operator's body. Location on the body places the sensing elements in proximity to one or more parts of the body, for which the apparatus will sense position and/or motion in relation to the apparatus and thus in relation to its location. In the example, the apparatus is a ring worn on a finger, in direct contact with the skin. However, the location on the body need not be directly in contact with the skin. The apparatus may be separated from the skin by a film, and those skilled in the art will recognize that implementations also may be mounted on articles of clothing or the like.

Figure 2:
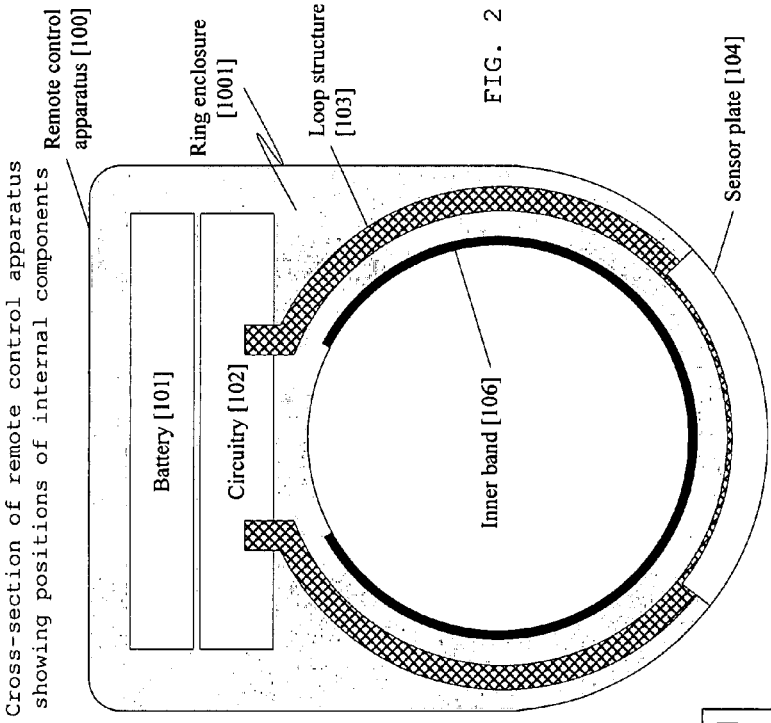
FIG. 2 is a cross-section showing the relative positions of the internal components of the remote control device.

The disclosed technology meets the principle ergonomic challenge by providing a remote control apparatus 100, shown by way of example in the form of a finger ring of usual proportions, as shown in FIGS. 1 and 2. The remote control system (FIG. 3) may be used for a variety of remote control applications, many of which involve control related movements by an operator, which the operator may do while engaged in other activities. FIGS. 4*a* and 4*b* show an example of how the remote control apparatus may be worn and used, even while playing an instrument, such as a guitar (notice the guitar pick 350).

The wireless remote control apparatus 100 senses position or motion of a part of the operator's body over a substantially continuous range of possible positions, in the general vicinity of the apparatus. In many applications, the wireless remote control apparatus 100 performs this sensing in real-time, while the operator is involved in physical manipulation of another object. The position or motion sensed by the remote control apparatus, however, need not be directly related to the object manipulation.

One application discussed in detail relates to control of an audio effects device during a musical performance, by a performing artist, and the example, uses a ring form factor that the artist wears on a finger of one hand, as shown in FIGS. 4*a* and 4*b*. The remote control apparatus 100 can sense position or movement of a part of the hand, e.g. all or part of a finger, even while the artist is using the same hand to play a musical instrument. For a guitar performance, the guitarist can pick notes or strum chords on the guitar using the hand; and during such manipulations, the guitarist can open and close the finger having the ring and/or adjacent fingers for the remote control application. The remote control apparatus 100 senses the finger movement, by taking measurements of the electrical field at the ring location on the hand, and the apparatus transmits a wireless signal responsive to the measurement or sensing results. A base unit generates a control signal based on the sensing results indicated in the received wireless signal. With this approach, it is not necessary for the guitarist to interrupt other activities using the hand to directly actuate the remote control apparatus.

Another advantage involves the provision of a continuous capacitive sensing mechanism, in conjunction with an effective transmission mechanism, management system, and power source in a compact enclosure 1001 of such that meets the aforementioned criteria.

FIG. 2 shows the internal view of the remote control apparatus, where the major components are capacitive sensing plate 104, electronic circuitry 102, a loop structure 103, an inner conductive band 106, and a self-contained power source such as rechargeable battery 101.

The disclosed remote control system realizes several of the stated objectives through a system architecture that:

a) Utilizes an operating frequency that allows for a small antenna that can be contained within the band of the ring, and that minimizes the effects of the wearer's tissue on RF performance;

b) Utilizes integral low power modes for periods of inactivity;

c) Utilizes a capacitive sensing technique that has low power requirements;

d) Utilizes a charge transfer sensing mechanism and an associated time variant scheme of encoding based on the sensing, which reduces RF transmission power requirements;

e) Utilizes a design in which the shape and placement of the sensor plate 104 can be easily optimized for size and sensitivity;

f) Generates the electrical field to be sensed immediately about the device, to conserve the field and the power required to generate it;

g) Employs a grounding scheme that protects the sensor plate and antenna from adjacent active components and from external interference; and h) Integrates the components in a space-saving manner, as follows:

The low power mode(s) obviates the need for manual power off mechanisms that take up space.

Use of a loop structure 103 that serves as a multitude of functions, including an antenna, a shield for the sensor, part as the conductive lead, and as a tuning mechanism for the antenna.

Use of a sensor design that offers a secondary purpose as a communications link for software upgrades.

Configuration of the battery 101 and circuit boards 102 provides structural support that allows for thinner walls of the enclosure 1001.

Use of an inner conductive band 106 that may participate in the grounding scheme; may participate in a tuning mechanism; may provide a connection point for recharging; may provide a mechanism for rigid/reproducible component placement; and increases dynamic range and sensitivity through contact with the flesh.

A time-sharing scheme enables elements of the loop structure 103 to predictably assume discrete functions during respective time slices, to include:

A measurement state, in which the loop structure 103 facilitates the generation of a preferred electrical field, and facilitates measurement of capacitance, through interaction with sensor plate 104;

A transition state, in which the loop structure 103 facilitates quiescence in the electrical condition of the remote control apparatus 100; and A transmission state, in which the loop structure 103 is utilized as an RF antenna, for wireless communication of a signal from the circuit 102 related or responsive to results of the capacitance measurement.

Figure 3:
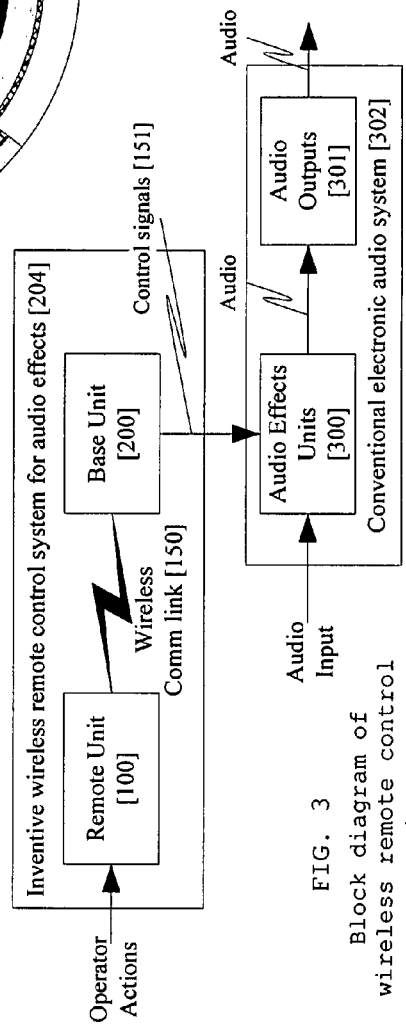
FIG. 3 illustrates an end-to-end system for controlling one or more connected audio effects devices, where such system involves the remote control device, an intermediate receiving (base) unit, and audio effects devices.
Figure 4B:
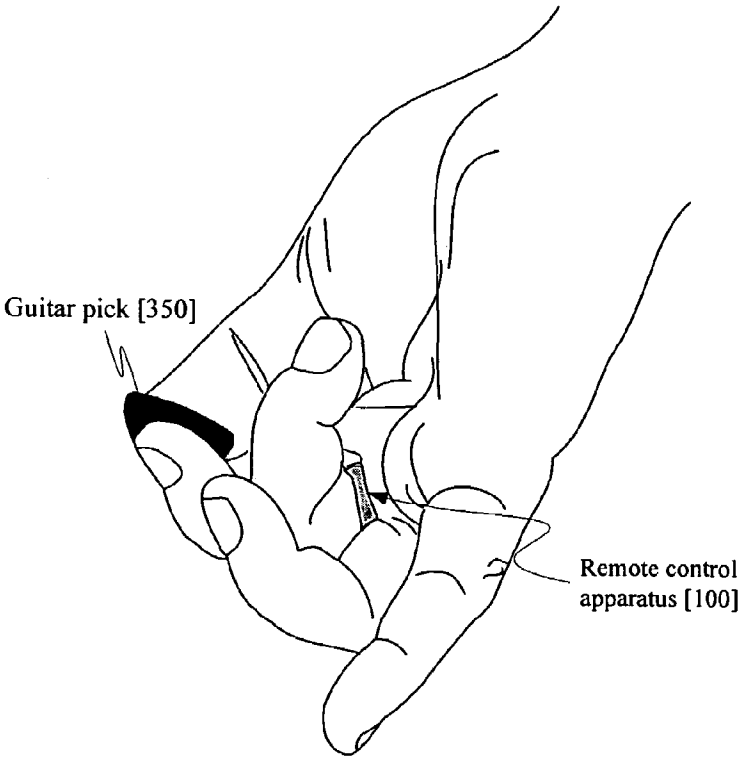
FIG. 4*a* and FIG. 4*b* show examples of how the remote control apparatus may be worn and used with an exemplary performing accessory, such as a guitar.
Figure 4A:
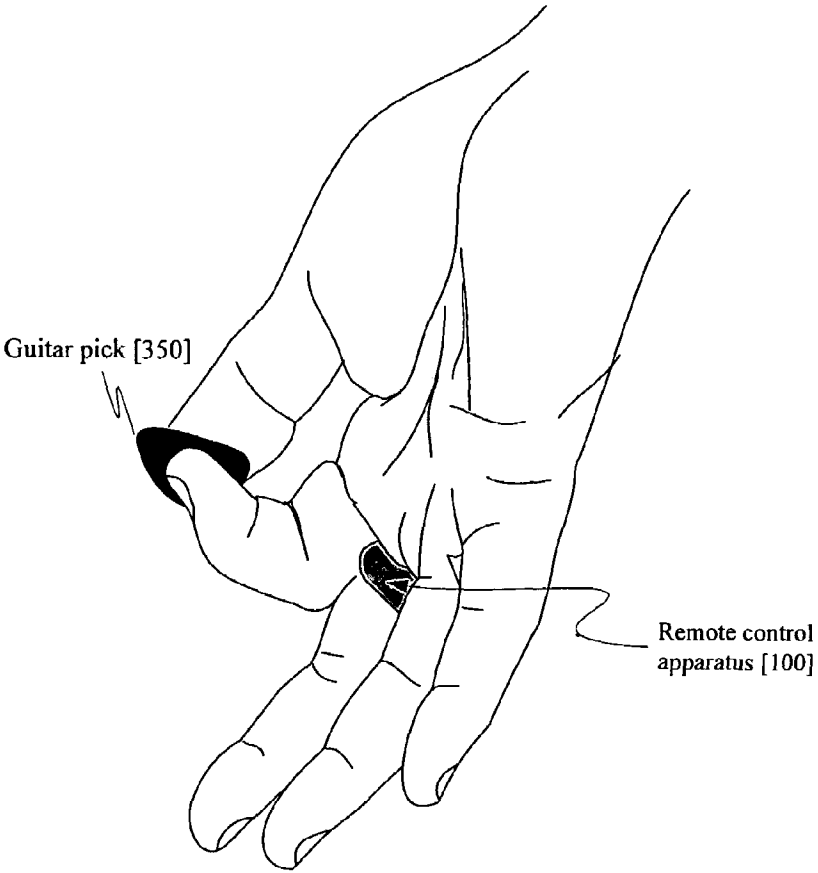

FIG. 3 illustrates how the remote control apparatus 100 works in conjunction with a stationary base unit 200 to form an integrated system 204 for the remote control of electronic audio effects devices. Hence, the remote control apparatus 100 communicates raw measures of capacitance to a base unit 200 for responsive processing and attendant control functions. The base unit receives RF data from the remote control apparatus 100, interprets the data according to system- and user-defined parameters, and conveys it to one or more connected audio effects devices 300 and/or audio output devices 301, which are part of a conventional electronic audio system 302. An advantage of the system 204 is its ability to respond in meaningful ways to the raw capacitive measures related to the electrical field, to derivations of the raw measures of capacitance (such as change or rate of change of capacitance, minima, maxima, etc.), and/or to patterns of raw or derived measures.

Another aspect of the disclosed technology relates to a novel method for communicating information based on the capacitive measurement results and other meaningful information from the remote control apparatus 100 to the base unit 200. The system employs both the encoded messages containing data 153 (introduced in FIG. 6*a*) and the silent period between messages to convey information, where the inter-message duration 154 (FIG. 10*a*) is derived from the capacitive measure. In a related aspect, the system employs a pulse width modulation (PWM) scheme (defined in FIG. 10*c*) to encode the messages. Another related aspect is the ability of the base unit to discern between signals transmitted by multiple remote control apparatus 100, using RF power correlation in combination with other characteristics of the messaging format (FIG. 11*a* and FIG. 11*b*).

Additionally, the disclosed system provides a user interface on the base unit that enables the operator to control certain operating parameters, and enables the user to select from and store for future use entire sets of operating parameters. Further, the system provides an interface that enables an external computing device to load complex configuration sets into the base unit.

Still further, the exemplary system provides a means for timely updates to the internal firmware of both the remote and base units.

Initial Application and Use

The remote control technology discussed herein enables subtle remote control operations, even if the operator is engaged in another activity. During physical manipulation of an object by an operator, position or motion of a part of the operator's body engaged in the manipulation of the object over a substantially continuous range of possible positions of the part of the operator's body is sensed in real-time. However, the sensed position or motion of the member or part of the operator's body need not be directly related to the object manipulation, and the operator need not directly activate the device, e.g. by moving it or activating a user input device. The remote control apparatus transmits a wireless signal from a location on the operator's body. The wireless signal carries information responsive to the real-time sensing of the position or motion of the part of the operator's body. The wireless signal is received at a location remote from the operator, and a control signal is generated for a controlled device, based on the information carried in the received wireless signal.

The remote control and base unit technologies may apply to the remote control of any system/device that can accept control signals, especially those systems/devices that involve nuanced control. For example, there may be applications that are useful to individuals who are physically challenged, e.g. paraplegic. For discussion purposes here, the initial example involves the application of the technologies as part of an electronic audio effects system 302 used for a musical performance. In such an application, the greatest effect can be obtained by correlating the behavioral, expression signatures to specific control behaviors. Exemplary uses include playing the electric guitar; vocal performances, especially those that rely on expressive gestures and intonations; and solos of all kinds. In many of these applications, the hand may be engaged in other activities, such as plucking or strumming strings of a guitar, not just the motion(s) related to the remote control operation.

A performance may involve audio effects devices that connect directly or indirectly to an instrument, where such devices include, but are not limited to stomp boxes, multi-effects units, audio amplifiers, and MIDI-based effects switchers.

An exemplary environment for such a performance is an indoor staging area. An exemplary performance requires approximately 100 feet latitude between a base unit and the performer that is using the remote control device 100.

Further, such a performance may involve multiple participants, applying remote control concurrently, such that each performer uses a dedicated instance of the nuanced remote control functionality.

Mode of Operation

Operation of this embodiment could include, but is not limited to the opening (extending) and closing (flexing) of a finger (see FIGS. 4*a* and 4*b*), a change in the overall shape of the hand, and/or the proximity of the hand to other objects. Note that the remote control device is also sensitive to the density of tissue in the hand caused by tensing of the muscles in the wearing hand and other factors.

For a performance control type mode of operation, the performer may wear the remote control apparatus 100 on any finger. However, because the capacitance being measured by the remote control apparatus 100 can be adjusted to be sensitive to perturbation by external objects, the inventors recognize that performing artists may use this variability to discover the most advantageous use of the device. Viable alternative operating techniques may include interactive hand movements, or the incorporation of foreign objects proximate to the remote control apparatus 100 and its sensor plate 104 (such as instruments).

Interfacing with Controlled Devices

The system will interface to one or more controlled devices. In the specific example, for performance applications, the system interfaces to at least one electronic audio effects device. To interface with these audio effects devices, the remote control apparatus 100 uses an intermediate receiving unit, also known here as a base unit 200. As shown in FIG. 3, the remote control apparatus 100 issues messages over a wireless communications link 150, which the base unit 200 receives and responds to the messages by generating responsive control information that is meaningful and consumable by the controlled device(s), and conveys the resultant control signals out one or more of its output ports to the connected devices 300 and/or 301. Subsequent sections of this document provide detailed descriptions of how this interface works.

Composition of the Loop Structure

Figure 8B:
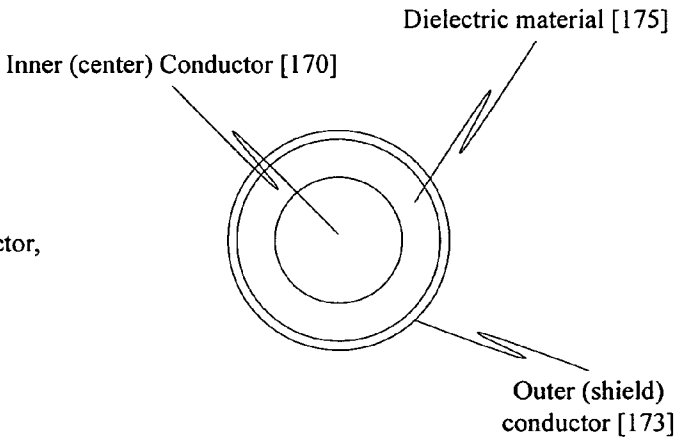
FIG. 8*b* shows a crosscut section of the loop structure.

The subsequent discussions of the capacitive sensing and RF transmission capabilities of the remote control apparatus 100 involve a multi-function loop structure 103. In the example, the loop structure is of a coaxial form, having a center conductor 170 and an outer conductor 173, separated by a dielectric material 175, as shown in FIG. 8*b*. The coaxial loop structure could be one of several implementations, including, but not limited to, cable, PCB, or flex circuit.

DETAILED EXAMPLE OF THE REMOTE SENSING APPARATUS

In an example, the remote control apparatus 100 consists of a ring shaped housing having a band and an enclosure, a sensor plate, a multi-purpose loop structure serving as the antenna and providing a coupling to the sensor plate, an inner band for skin contact and grounding, electronic circuitry and a rechargeable battery power source.

Figure 6A:
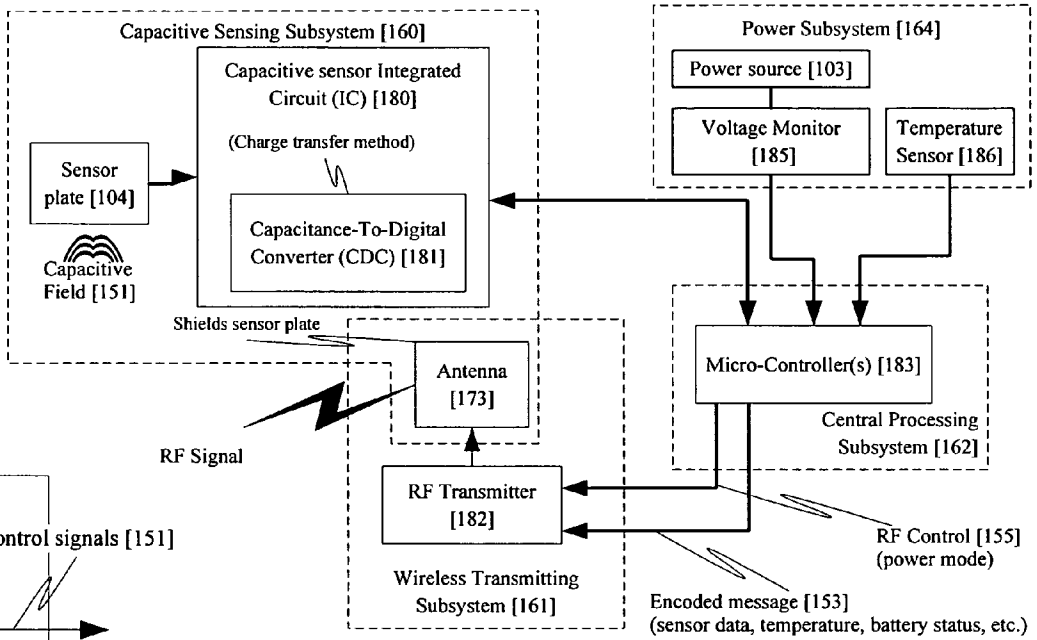
FIG. 6*a* provides a high-level circuit diagram of all the electronic systems in the remote control apparatus.
Figure 5:
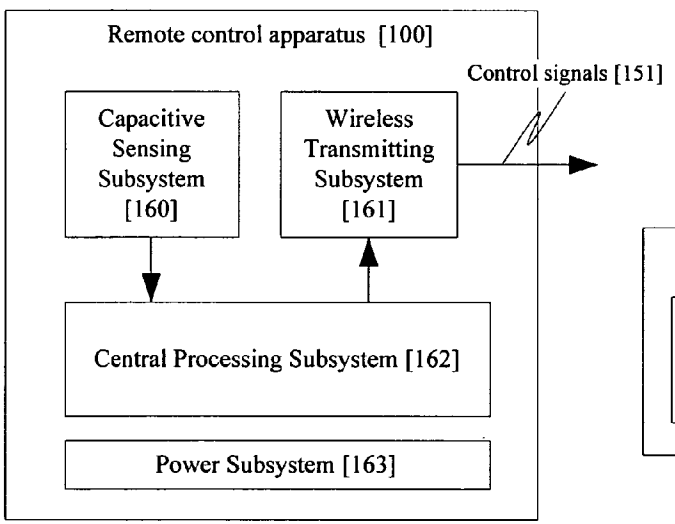
FIG. 5 provides a high-level functional architecture of the remote control apparatus.

FIG. 5 shows a high-level block diagram of the electronic subsystems of the remote control apparatus, whereas FIG. 6*a* provides a high-level circuit diagram. A capacitive sensing subsystem 160 consists of one or more capacitive sensor plates 104 that connect to the associated electronics, via a shielded sensing lead 171 of a loop structure 103. A wireless transmitting subsystem 161 consists of an antenna 173 and associated electronics used to transmit radio frequency (RF) signals. A central processing subsystem 162 manages inputs from the sensing component, processes the input as a signal, and outputs the signal to the transmitting subsystem. A power subsystem 163, containing an integral power source 103, drives the internal circuitry.

Shape for the Exemplary Ring Enclosure

The illustrated embodiment of the remote control apparatus 100 is an enclosure 1001 in the form of a finger ring, as shown in FIG. 1. Such a ring fits on the wearer's finger and is of usual proportions (see FIG. 4), being manufactured according to conventional ring sizes used by the jewelry trade. The housing 1001 (FIG. 1), in the form of a ring of usual proportions, is fashioned from materials that are particularly suitable to the operating environment, e.g. plastic with the sensing and electronic components embedded or encased therein. The housing includes a band and an enclosure.

The present teachings are not limited to a ring shaped remote control device. The remote control apparatus can be implemented for any part of the body, an instrument, or location where the performer can modulate the capacitance to the sense plate to achieve the transmission of the desired control messages.

Referring to FIG. 2, the illustrated embodiment houses a rechargeable battery 101 and electronic circuitry 102 in the enclosure at the top of the ring, while the top of the ring protrudes no more than would be customary for a man's ring (see FIG. 1). However, the remote control apparatus is not limited to a rechargeable battery as its power source, nor to a specific space allocation for the power source or the circuitry. Possible alternatives for the power source include externally induced power.

To enable the sensing system, the embodiment places one or more sensor plates 104 at the base of the band of the ring. Thus, the band is of sufficient depth to enclose the sensor plate 104 and the loop structure 103, elements of which serve the transmitting system and the sensing system.

To ensure effective operation of the sensing system, the shape of the band—and thus of the sensor plate 104—is designed to optimize sensitivity to the geometry of the fingers (see FIG. 1).

Materials and Construction of the Ring Enclosure

In the embodiment, the ring enclosure 1001 is constructed of a non-conductive material, having a low RF absorption coefficient, consistent dielectric coefficient with respect to temperature, and acceptable mechanical characteristics suitable to routine use on the hand in potentially hostile environments. Regarding the latter point, the material is hard enough to withstand both physical abuse and chemical interactions, including body fluids, soaps, alcohol, and other adverse environmental conditions as required. Examples include Ultem (GE trademark), Polycarbonate, etc.

Figure 14B:
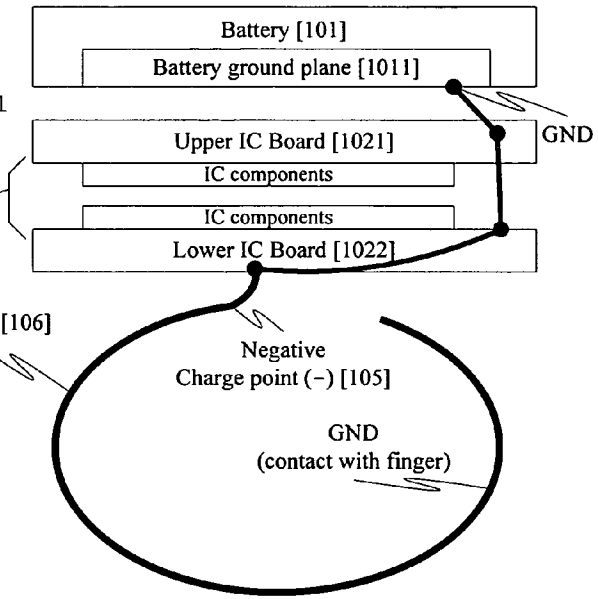
FIG. 14*b* is a schematic diagram of the grounding scheme, including aspects of the battery, circuit boards, and inner band.

The adjacent configuration of battery 101 and IC boards 1021 and 1022, FIG. 14*b* provides the ring with needed structural integrity, especially with respect to forces placed on the top of the ring enclosure 1001, and especially considering the possible physical abuse to which the ring may be subjected.

Detecting Movements by Establishing and Sensing an Electrical Field

To effectively detect behavioral expressive signatures, the remote control apparatus 100 has the ability to sense the electrical field in the ambient space immediately about it. It does so by sensing the charge on a capacitance formed between its sensor plate 104 and the performer's finger, for example that is electrically linked to the inner conductive band 106, see e.g. FIG. 2. As the operator operates the device, through the opening (extending) and closing (flexing) of a finger or other means, as described above, the remote control apparatus 100 transmits a continuum of information based on the capacitive measurement results, that is to say, the results of the sensing of the electrical field in this example. Remote control operations, responsive to the wireless communication, can be based on information related to or derived from the raw measures, such as direct sensing results or changes in capacitive measurement results.

The illustrated embodiment allows for the use of a capacitive-based sensing system 160, shown in block diagram FIG. 5, that both establishes a desired electrical field about a sensing mechanism and senses capacitance and/or charge on a capacitance formed between a sensor plate and a ground plane. The physical components of this system are shown in FIG. 2: the sensor plate 104, a loop structure 103, electronic circuitry 102, and battery 101.

The illustrated arrangement allows for the topology of the sensing components, along with power, to tune and determine the characteristics of the electrical field. The inventors recognize that specific uses of the remote control technologies will determine the electrical field required to provide optimal results.

An ancillary component of the capacitive sensing system in the remote control apparatus 100 is the conductive inner band 106, which provides contact with ground (the operator's finger), and may thus greatly extend the dynamic range of the detectable variations in capacitance.

Figure 8A:
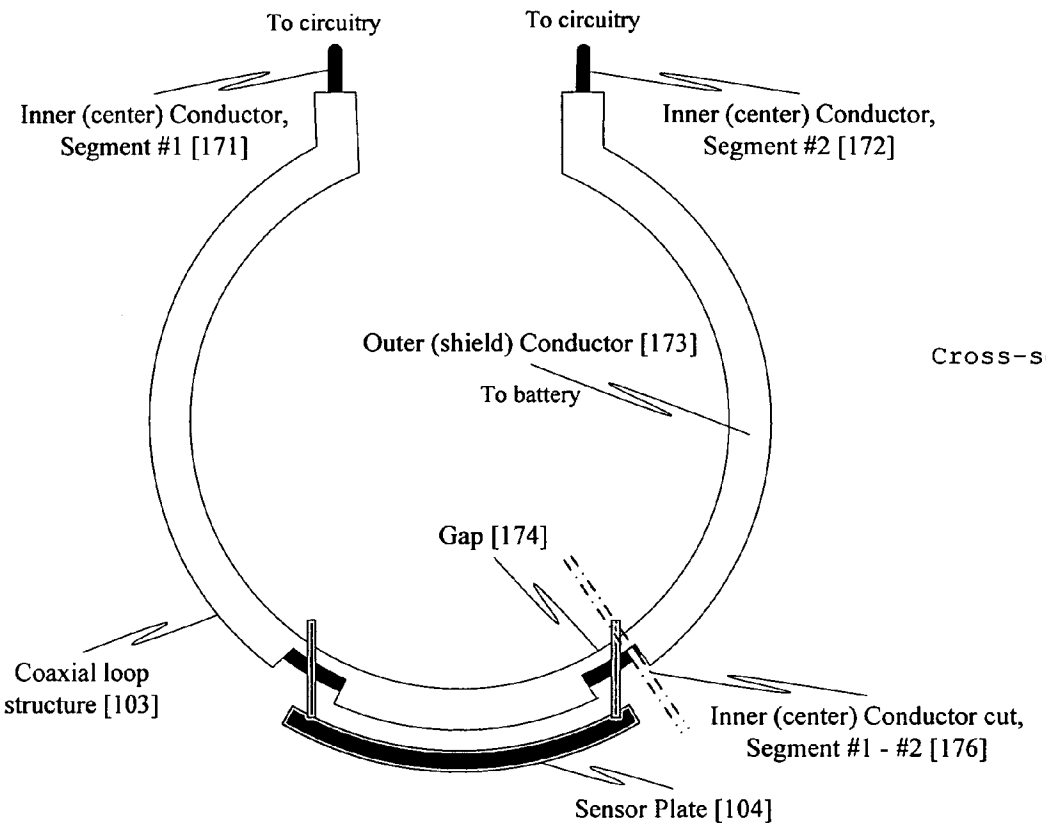
FIG. 8*a* shows a front view of the loop structure assembly within the remote control apparatus, which is used for both the capacitive sensing system and the antenna for transmitting control signals.

FIG. 8*a* shows a physical view of the loop structure-sensor plate assembly, in which the center conductor is divided into two segments via a cut 176. The first or #1 segment is identified by numeral 171, and the second of #2 segment is identified by numeral 172. Segment #1 of the center conductor functions as a conductive lead (sensing lead) from the sensor plate 104 to the circuitry. Contact between the sensor plate 104 and the sensing lead formed by the first conductor segment 171 is enabled by one of the gaps 174 in the outer (shield) conductor 173. The outer conductor 173 serves as a shield for the sensing lead 171, reducing the ambient electrical noise potentially affecting the sensing lead, and thus reducing the level of undesired stimulus to the sensing circuit. The design accomplishes this shielding by: a) biasing the outer conductor to battery voltage (FIG. 6*a*); and b) employing a dielectric material 175 (FIG. 8*b*) between the two conductors within the loop structure for maintaining stable cable internal capacitance. Thus, the effective sensor is reduced to the sensor plate 104.

Figure 7B:
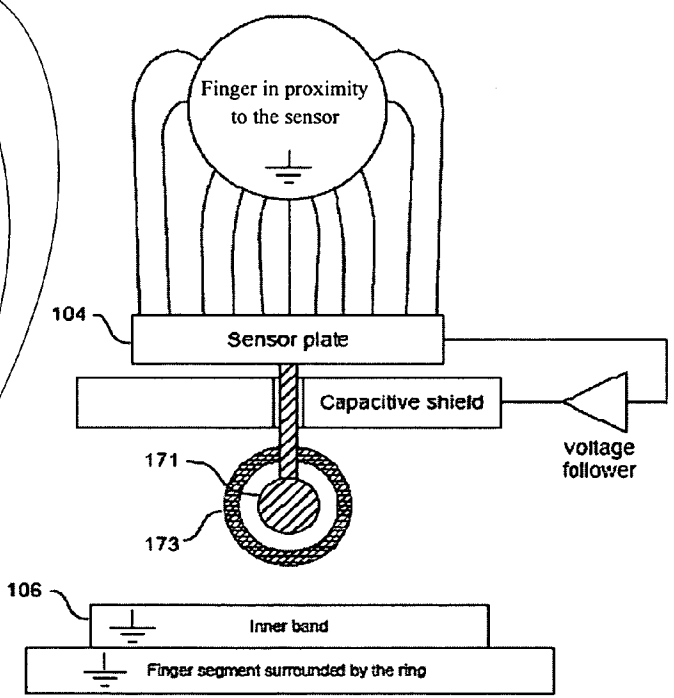
FIG. 7*b* illustrates the field lines of the exemplary capacitive sensing field, in an embodiment that employs a capacitive shield to eliminate stray capacitance between the sensor plate and the other parts of the remote control apparatus.
Figure 7A:
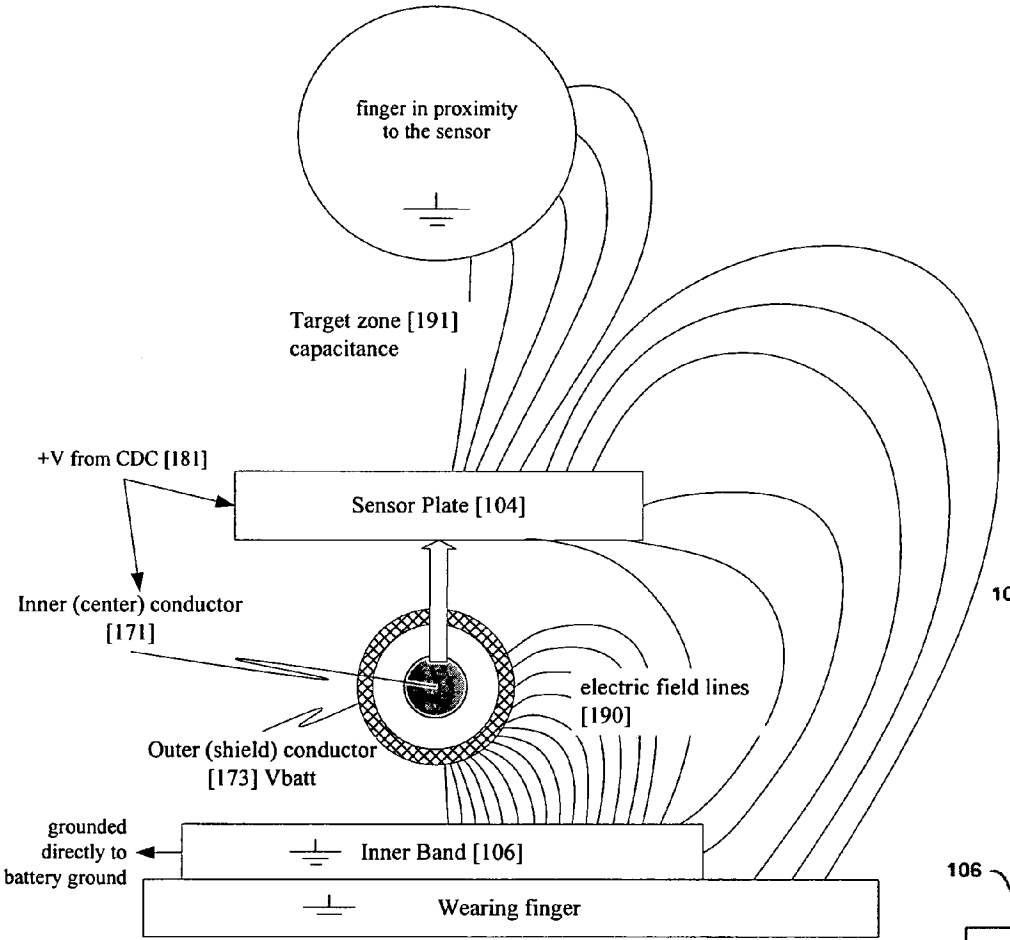
FIG. 7*a* illustrates the field lines of an exemplary capacitive sensing field, generated and sensed by the remote control apparatus. The field lines between the center conductor and outer (shield) conductor are not shown.

FIG. 7*a* illustrates an exemplary electrical field 190 that satisfies the objectives of this embodiment. Such a field is focused about a target sensing area (zone) 191 for effective detection of positional variations of the wearing finger, using a capacitive sensing technique. In FIG. 7*a*, the parasitic capacitance is indicated by the electric field lines between the sensor plate 104 and other elements of the ring. This disclosure does not preclude reducing the effects of the parasitic capacitance or varying the field by methods such as providing a shield in the proximity of the sensor plate 104 that carries a static or time varying potential relative to that of the sensor plate 104 (as shown in FIG. 7*b*). In this example, the outer conductor 173 itself could act as such a shield if driven by a voltage follower to track the sensor plate voltage during the capacitance measurement which has been previously referred to, in published works, as a "Capaciflector".

Further, because the outer conductor (shield) is biased to the battery voltage, the field 190 about the sensor plate 104 is extended in a focused manner away from the hand, toward the target zone.

Segment #2 172 may be left un-terminated or used to tune/monitor the antenna (Outer (shield) Conductor 173).

In the example of FIGS. 4*a* and 4*b*, the ring type remote control apparatus 100 is worn on the proximal segment of a finger of the musician's hand. This segment corresponds to the 'wearing finger' shown at the bottom of FIG. 7*a*. The field in the target zone 191 is perturbed in a detectable manner by other elements within the target zone, such as another part of the finger, another part of the hand, another body part or an element in proximity to the hand (e.g. on the musical instrument). In the example of FIGS. 4*a* and 4*b*, the element that changes in proximity to the remote control apparatus 100 might be the distal segment of the finger on which the musician wears the ring, i.e. corresponding to the 'finger in proximity to the sensor' shown in FIG. 7*a*.

Material, Placement, and Shape of the Sensor Plate

Figure 9B:
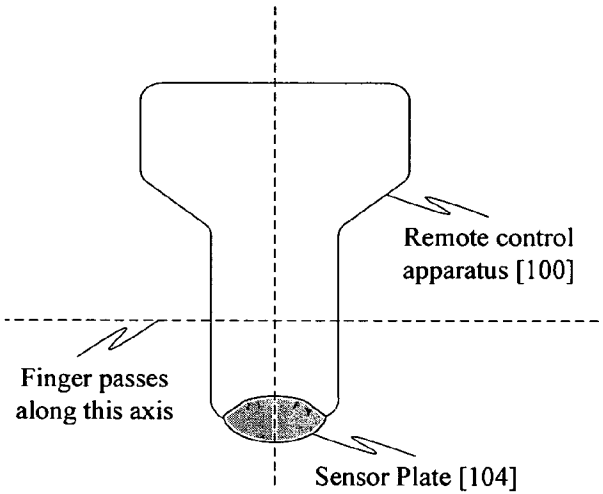
FIG. 9*b* and FIG. 9*c* illustrate the position of the sensor plate, in an example.
Figure 9C:
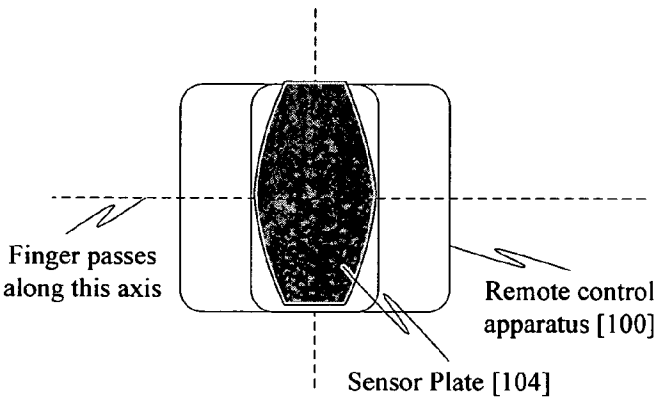
Figure 9A:
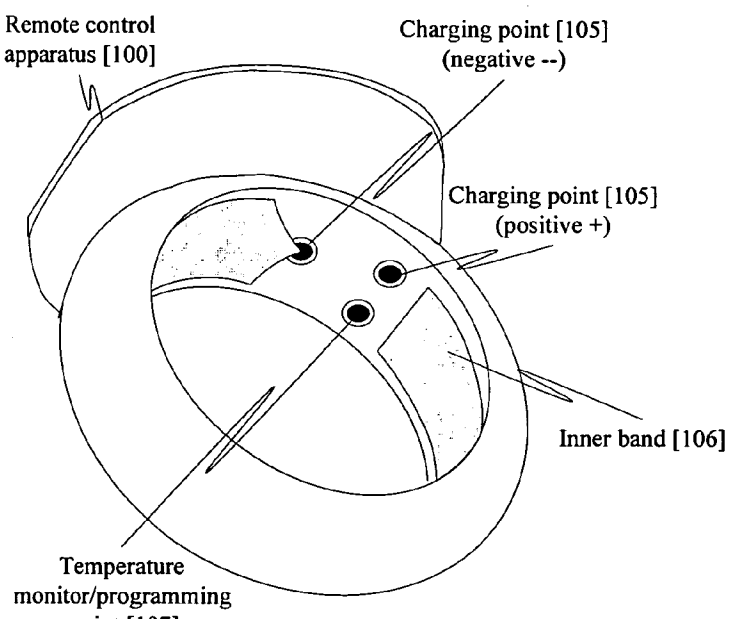

The embodiment of the capacitive sensor plate 104 is a conductive plate, located on the outside of the ring 1001 band, and conforming to the outer shape of the band, as shown in FIG. 1, FIG. 8*a*, and FIG. 9*a*. With respect to the embodiment, the following description further characterizes the location and shape of the sensor plate. The sensor plate 104 is centered along the medial axis of the ring (from top to bottom), so it is symmetrical with respect to the front, bottom (FIG. 9*c*), and side (FIG. 9*b*). The sensor plate 104 has limited coverage of the lateral surfaces of the ring's band; and the sensor plate 104 is of a roughly hexagonal-to-oval shape, with its base wider than its height (FIG. 9*c*). These characteristics enable the sensor plate 104 to suitably detect perturbations in capacitance, for the preferred application. As stated earlier, the inventors recognize that specific uses of the invention will determine the electrical field and capacitance required to provide optimal results, and thus dictate the exact position and shape of the sensor plate or an array of sensor plates.

Measuring Capacitance

Refer to FIG. 6*a*. In the example, a capacitive sensor Integrated Circuit (IC) 180 is equipped with a Capacitance-To-Digital Converter (CDC) 181 to measure capacitance, based on a charge transfer method. Essentially, the CDC 181 cyclically obtains a charge transfer from the sensor plate 104 as a measure of the capacitance at the sensor plate 104: and in response, the CDC 181 produces a representative digital value. It is capable of measuring femtofarad-level (10 E15 farad) of capacitance.

To further one or more of the objectives, the embodiment may employ an auto-calibration feature for the capacitive sensing system 160, such that each time the remote control apparatus 100 is placed on the charging unit 400, the base unit 200 detects a long period of inactivity, and registers the low end of the dynamic range associated with the absence of a finger inside the ring. Thus, the invention may be better able to identify the power-saving "sleep mode," described later, and avoid false positives related to sleep mode.

Figure 6B:
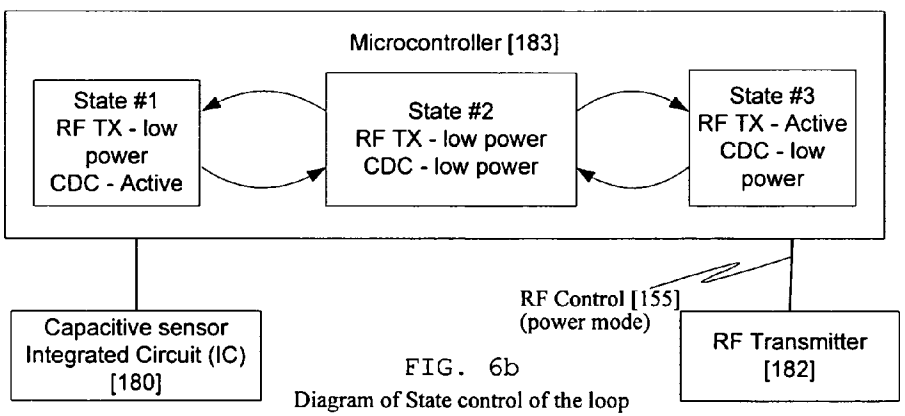
FIG. 6*b* provides a diagram of state control of a loop structure assembly of the remote control apparatus via a microcontroller.
Figure 6C:
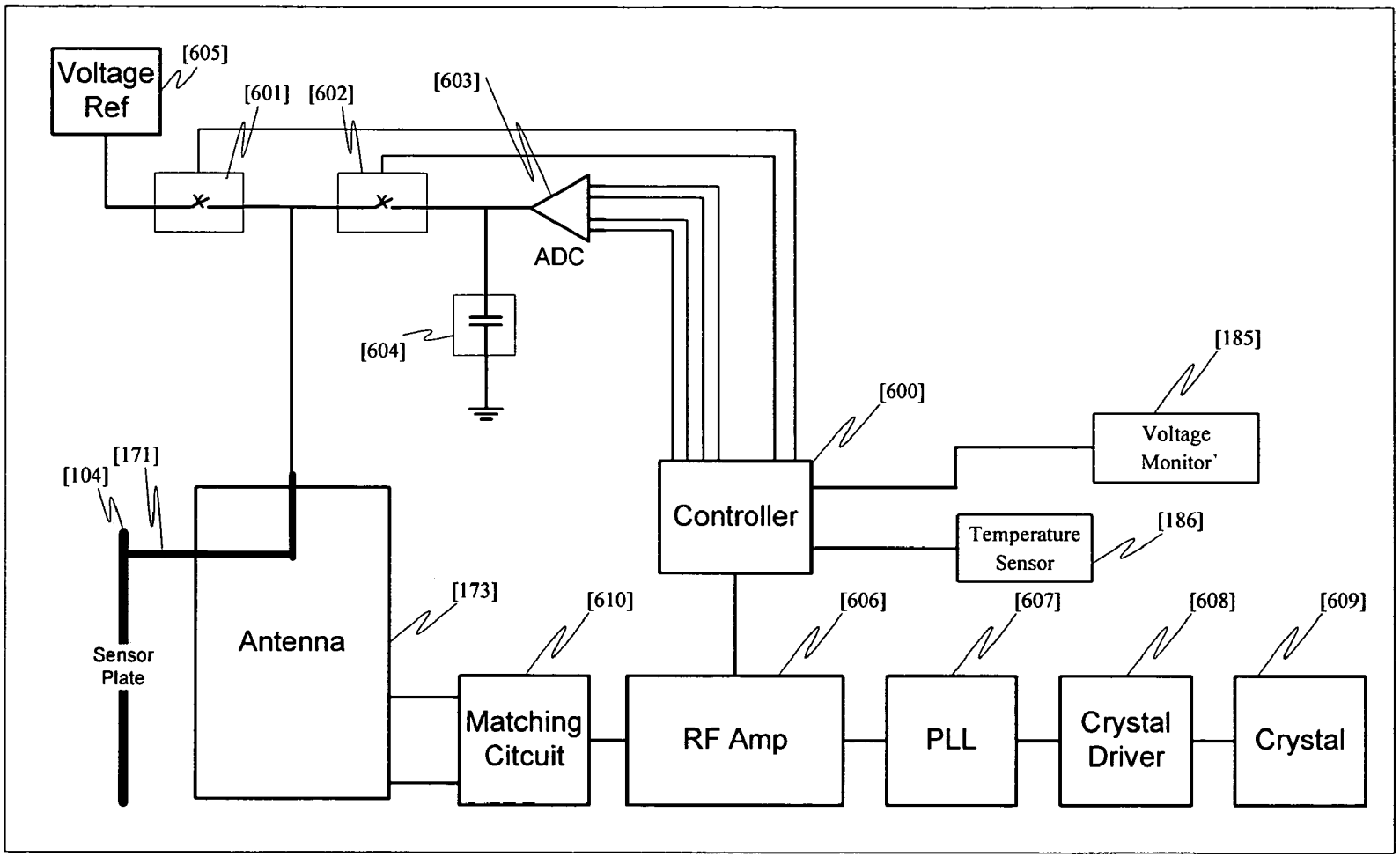
FIG. 6*c* provides another example of a circuit embodiment.

FIG. 6*c* is a block diagram of another exemplary implementation of the circuitry for the ring type wireless remote control apparatus. Controller 600, such as a CPU microprocessor controller, provides the control logic for the remote control apparatus, in a manner analogous to the micro-controller 183 in the block diagram of FIG. 6*a*.

Figure 6D:
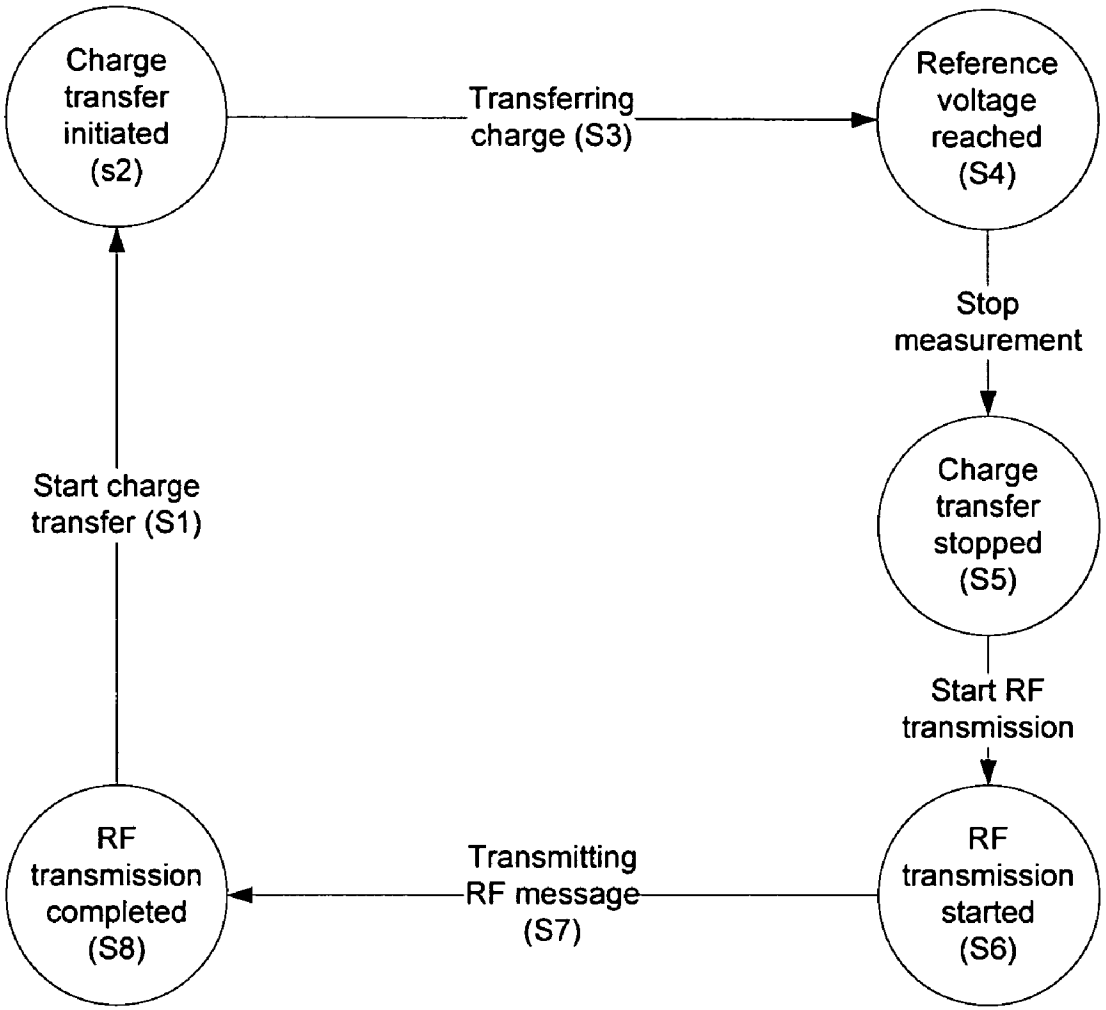
FIG. 6*d* provides a diagram of states of operation of the circuit of FIG. 6*c*.

In this example, a charge transfer-based capacitance measurement system includes a charge detector capacitor 604, an analog-to-digital converter (ADC) 603, a voltage reference 605, and charge transfer switches 601 and 602. As discussed later, a sensor lead 171 provides a connection to the sensor plate 104. FIG. 6*d* shows the states of operation of the apparatus of FIG. 6*c*. To initiate a measurement (from state S1 to S2), the controller 600 operates switches 601 and 602 in a high speed alternating fashion thereby repeatedly charging the sensor plate and discharging it into charge detector 604 (state S3). The ADC 603 converts the charge on charge detector capacitor 604 to a digital value and presents it to controller 600. Controller 600 ascertains from the ADC value when the charge has reached the reference voltage, that is to say when the charge-transfer based capacitive measurement has been completed as depicted at state S4 in FIG. 6*d*.

The higher the capacitance at the sensor plate 104, the greater the charge, and thus the faster that charge transferred to the charge detector capacitor 604 will reach the reference voltage 605. As a result, for a higher sensor plate capacitance, the time to complete a measurement will be shorter than for a lower sensor plate capacitance.

Each time that a measurement is completed, the controller 600 deactivates the charge transfer process (S5), and at the same time, the controller 600 activates one or more circuit elements involved in the actual wireless transmission (S6-S8). The cycles of measurement and transmission are those shown in FIGS. 6*b* and 6*d*.

The illustrated implementation (FIG. 6*c*) also includes a RF transmitter. Here, the transmitter includes a frequency setting crystal 609, a crystal driver 608, a phase lock loop 607, a RF amplifier 606, the antenna 173, and an antenna matching circuit 610. The crystal 609 and associated driver circuit control the RF frequency of a signal generated by the phase lock loop circuit 607.

The controller activates the RF amplifier 606 in such a manner that the antenna will radiate a transmit signal, comprising bursts of RF wave signals from the output of the phase lock loop 607. The matching circuit applies to amplified bursts of RF to the antenna for wireless radiation over the air to the base unit. The wireless transmission from the antenna provides the means for transmitting the measurement (results of the sensing) at the sensor plate 612 to the wireless receiver in the base (receive) unit.

As discussed more later, the controller 600 activates the transmitter in response to its timing of the completed charge transfer type capacitive measurement, that is to say, so that the durations of time intervals between transmissions relates to the times required to complete the charge transfer measurements of the electric field at the sensor plate.

Reporting Capacitive Measurements

In the embodiment of FIG. 6*a*, upon each charge transfer, the IC 180 sends a 16-bit value from the CDC 181, equating to a relative capacitance, to the microcontroller 183 via a communications link. The microcontroller 183 encodes a data message 153 containing meaningful information, and passes it to the RF transmitter 182 for transmission.

Each encoded message from the remote control apparatus 100 to the receiving base unit 200 is data that may serve two purposes: a) demarcates the duration between transmissions (i.e., inter-message period) 154, as an interpretation of the capacitive measure; and b) conveys a semantic bit pattern. Thus, the system may communicate capacitance through these inter-message durations.

Figure 10A:
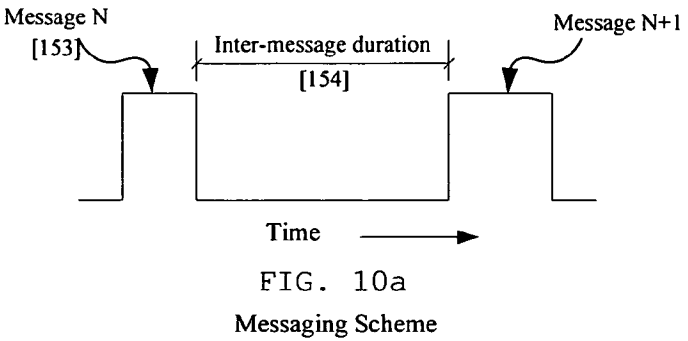
FIG. 10*a* illustrates the digital messaging scheme used to transmit information from the remote control apparatus to the base unit.
Figure 11B:
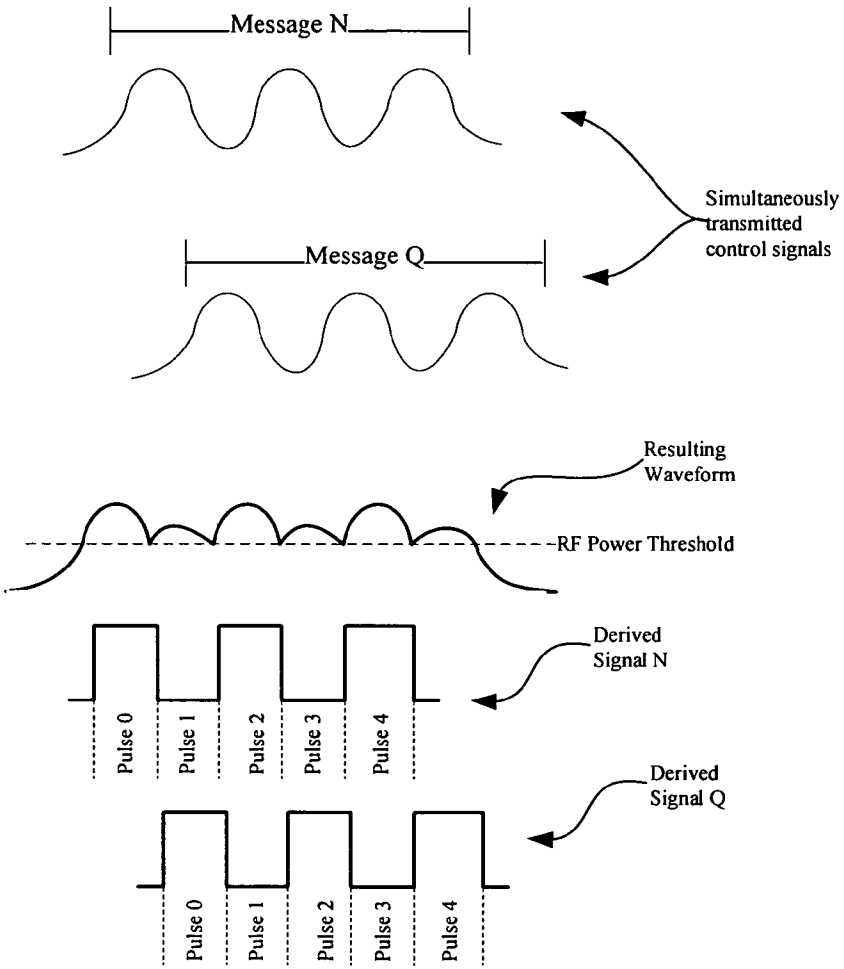
FIG. 11*b* illustrates the sampling of multiple simultaneously transmitted control signals by the base (receive) unit, and the resulting derivation of multiple messages from a combined waveform.
Figure 11A:
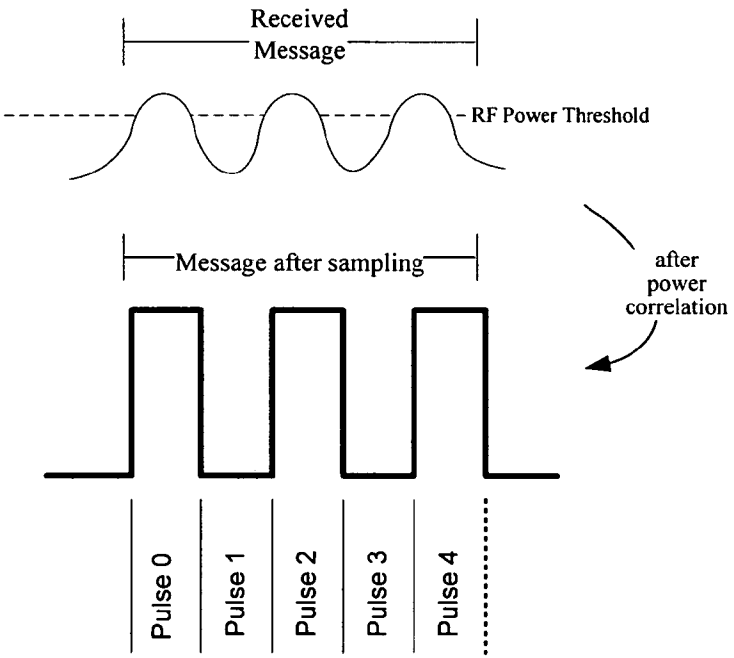
FIG. 11*a* illustrates the sampling of a waveform by the base (receive) unit, using a power correlation technique.

FIG. 10*a* shows the messaging scheme, where the inter-message duration is the time from the end of receipt of a given message (N) to the beginning of receipt of the next message (N+1). Those skilled in the art will understand that the inter-message duration may be based on any permutation of beginning, end, or intermediate point within messages.

The system allows for the inter-message duration to be derived as any mathematical function of the results of the electrical field sensing, in this case measured capacitance (i.e., Time=f(Capacitance)). On the receive end, the base unit 200 interprets the inter-message duration 154 as a value that ultimately indexes to the relative capacitance present in the region local to the sensor plate 104. The base unit 200 may subsequently apply transformations to this value.

Figure 10B:
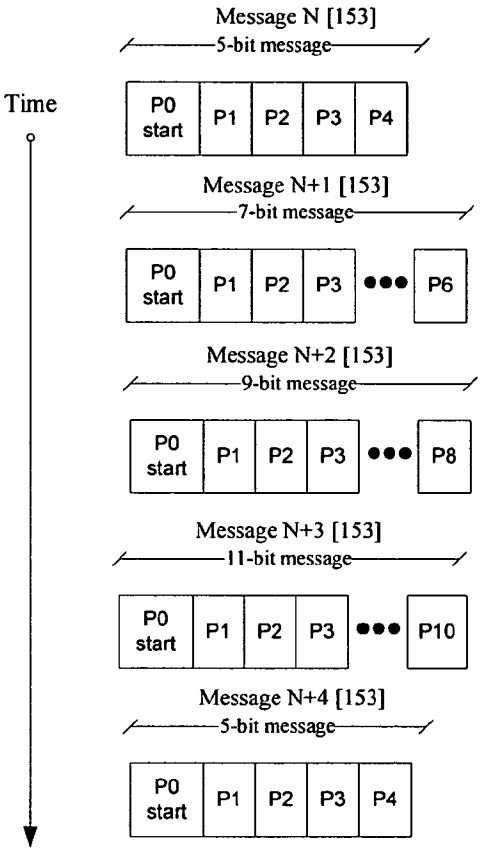
FIG. 10*b* illustrates the messaging scheme used to communicate semantic bit patterns to the base unit.

The message 153 may contain meaningful data, such as identifying information about the ring and/or base unit, capacitance, temperature, minimum capacitance and/or temperature, maximum capacitance and/or temperature, battery level, etc. In the embodiment, the remote control apparatus 100 employs a pulse width modulation (PWM) scheme to: a) convey a bit pattern; and b) codify a signal protection scheme that reduces the likelihood of interference. The embodiment uses a sequencing scheme that encodes messages, as shown in FIG. 10*b* and has the following characteristics:

a) A start pulse (P0), having the value 0, indicates the beginning of the message and can be used as a reference for the evaluation of pulses P1-Pn.

b) A mutually derivable sequence of pulse patterns.

Figure 10C:
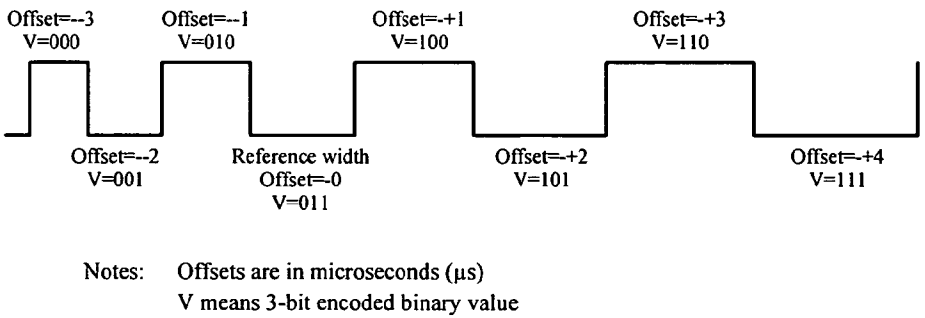
FIG. 10*c* illustrates the pulse width modulation (PWM) scheme used to encode data bits.

The embodiment employs a PWM scheme, shown in FIG. 10*c*, to encode the message. The example has the following characteristics:

a) The reference pulse is (Nref), for a base bit rate of 33.3 kHz Nref=30 microseconds, wide.

b) Each pulse carries three bits of semantic data.

c) A set of discrete offsets from the reference pulse convey correspondingly discrete values, where the range of offsets is from −3 microseconds to +4 microseconds, including a 0 offset.

Thus, each pulse conveys the value from decimal zero (000 binary) to decimal 7 (111 binary), as shown in FIG. 10*c*.

Thus, for example, a 9-pulse message with the following offsets:

P0|0|−2|−2|−3|+1|+2|+3 corresponds to this binary form:

0|011|001|001|000|100|101|110

The extent of the sequencing and number of bits per pulse are specific to the intended application and may be omitted.

The combined effect of the mutually derivable sequence of pulse patterns and the pulse width modulation scheme aids in isolating a message 153 amidst noise and interference. In any case, each inter-message duration between successive messages represents a new index or measure of the capacitance at sensor plate 104.

Providing an RF Antenna

The antenna of the illustrated embodiment is integral to the remote control apparatus 100. Thus, the embodiment employs a loop antenna, in the form of the outer (shield) conductor 173 of the coaxial loop structure 103 that runs inside the band of the ring (as shown in FIG. 8*a*). In the embodiment, the dielectric material 105 between the center conductors 171, 172 and the outer conductor 173 insulates the antenna (outer conductor 173) from interference caused by the conducting (sensor) lead 171, in the form of the center conductor.

Static tuning of the antenna may be accomplished by the interaction of the ring's shape, the position and constitution of the sensor plate 104, the physical and electrical characteristics of the coaxial structure, the shape and size of the gaps 174, or lack there of, in the outer conductor, the material selection of the ring enclosure, and the configuration and materials of the inner conductive band 106, all shown in FIGS. 2 and 8*a*.

Additionally, the embodiment provides a mode for real-time tuning and monitoring of the provided antenna. Segment #2 172 of the center conductor 170 may serve as a coupler to the antenna. Through this coupler, real-time tuning/monitoring may be accomplished through the addition of an appropriate RF matching circuit and/or other traditional RF circuits.

Time Sharing the Coaxial Structure

It should be apparent now that the outer conductor 173 of the coaxial loop structure 103 acts in multi-functional capacity: a) as an antenna and b) as a shield to the sensor plate 104 connector lead 171. These two functions are accomplished by time division multiplexing—at certain times the conductor 173 functions as an antenna and at other times the conductor 173 functions as a shield for the sensor plate 104 connector lead 171. The embodiment utilizes a cycle of four time slices, corresponding to three distinct internal states of the circuitry of the remote control device, FIG. 6*b*. The states include a state # 1 configured for performing a measurement and a state #3 configured for use as an RF transmit-antenna. Transition from state #1 to state #3 involves a transition through a quiescent intermediate state #2, and transition from state #3 back to state #1 involves a transition through a quiescent intermediate state #2. Note that other multiplexing schemes are not precluded.

The outer conductor 173 has a common condition for each state: it is biased to +VBattery and coupled to ground via one or more capacitors.

In time slice #1, known here as the measurement state #1, segment #1 (171) of the center conductor 170 connects to the CDC type sensing circuitry 181. As shown in FIG. 6*b*, in state #1, the CDC is active. In this way, conductor segment 171 is used as a transmission line connecting the capacitive sensing plate 104 to the capacitance sensor circuit 180, for the charge transfer for the capacitive measurement by the active CDC 181. This restricts the area of measurement to the capacitive sensor plate 104. The outer conductor 173 itself also provides a means to ensure that the measurement is restricted to the region normal to the sensor plate. As noted, the outer conductor 173 has a common condition for each state: it is biased to +VBattery. During this first time slice, the CDC 181 measures capacitance and produces a corresponding 16-bit measurement value, which it supplied to the micro-controller 183.

In time slice #2, known here as the transition state #2, the segment #1 (171) of the center conductor 170 is held at +VBattery or −VBattery. Again, the outer conductor 173 has a common condition for each state: it is biased to +VBattery. The connection of the center conductor 170 to +VBattery or −VBattery to create a stable condition, in this time slice, in preparation for a subsequent transmission.

In time slice #3, known here as the transmission state #3, segment #1 (171) of the conductor 170 remains held at +VBattery or −VBattery, and the outer conductor 173 has a common condition for each state: it is biased to +VBattery. In this state, the RF Transmitter 182 applies an RF signal containing a new message to the conductor 173, so as to use the outer conductor 173 as an antenna to send the new message over the wireless link. The micro-controller 183 controls the pulse transmission and in particular the timing of the message transmission, as discussed above. Of note, the inter-message duration from the last prior message transmission is a function of and thus represents the 16-bit capacitance measurement value from the CDC 181.

In time slice #4, processing with regard to use of the coaxial loop structure 103 returns to the transition state #2, in which segment #1 (171) of the center conductor 170 is held at +VBattery or −VBattery. In this time slice, the connection of the center conductor 170 to +VBattery or −VBattery creates a stable condition, here in anticipation of the subsequent measurement.

In this way, in the 4 time-slice cycle, the remote control apparatus consumes substantial power only during the actual RF transmission in state #3. The other states consume relatively little power. For example, relatively little power is drawn for the charge transfer from the sensor plate 104 to the CDC 181 to measure the capacitance of the sensor.

Power

In the embodiment, the remote control apparatus 100 requires an integral power source, in the form of a rechargeable battery 101. To facilitate ease of use and realize some or all of the stated objects, the battery must be light and thin, support a period of use that enables users to practice and perform to their satisfaction, and has a useful lifetime that is also satisfactory to users.

The battery must be sufficient to transmit messages via RF and drive the internal circuitry 102. Further, the battery must not interfere with capacitance in the field of interest (target zone) 191, while appropriately biasing the outer conductor 173, for shielding the connector (sensor lead) 171 from the sensing plate 104. The fundamental way that the embodiment conserves battery life is through a microcontroller 183 that implements one or more low power modes.

One lower power mode relates to a method for using temporal resolution, based on charge transfers, to report data pulses. Thus, the battery discharges significant amounts of energy only when it transmits. As discussed in the preceding section, the remote control apparatus consumes substantial power only during the actual RF transmission in state #3. The other states consume relatively little power. For example, relatively little power is drawn for the charge transfer from the sensor plate 104 to the CDC 181 to measure the capacitance of the sensor.

Figure 14C:
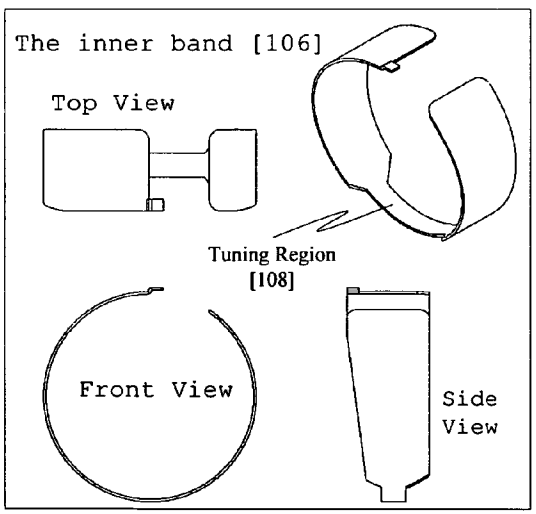
FIG. 14*c* is a diagram of an inner band configuration example.

The remote control apparatus enters another low power mode—sleep mode when the power management function of the microcontroller detects that the ring has not been worn for a pre-determined amount of time. In sleep mode, the ring uses a minimal amount of power, just enough to maintain the ability to periodically awaken, poll the CDC 181, and return to sleep. Should the capacitance reading be significant, it may cause the microcontroller to 'wake-up' and exit the low power mode. Additionally the sensing system's design enables the device to restrict the detection of actual use to specific regions in close proximity to the sleeping remote control apparatus 100. The inner band 106 can serve to shield the sensor plate 104, to varying degrees based on the topology of band tuning region 108 (FIG. 14*c*), from changes in local environment in the interior region of the remote control apparatus 100. The ring example of the device can be configured to awaken only when the user in is contact with the inner band 106 and continues to do so for a configurable period, whereas simply carrying the device may not affect mode selection even though there may be changes in the detected capacitance. This method may be extended to use a time/data based recognition method to enable more elaborate mode selection methods. The microcontroller is programmed to implement these modes.

Renewing the Power Source

To realize various objectives of the disclosed control system, the embodiment of the remote control apparatus 100 may have a replaceable or rechargeable battery 101. An exemplary battery that realizes several objectives—including usable period and ease of use—is a rechargeable lithium ion button cell.

The embodiment provides means to charge the ring battery 101 when the ring is not being used as a remote control. However, this example does not preclude use of other power sources, such as, but not limited to, replaceable batteries, externally induced power and/or induced charging of a rechargeable battery, and/or a super capacitor.

To facilitate replacement, and to realize several other objectives, including grounding and structural integrity, the battery is situated in the top of the ring enclosure 1001, where it is fitted under the lid of the ring enclosure in the example (see FIG. 2).

Figure 12:
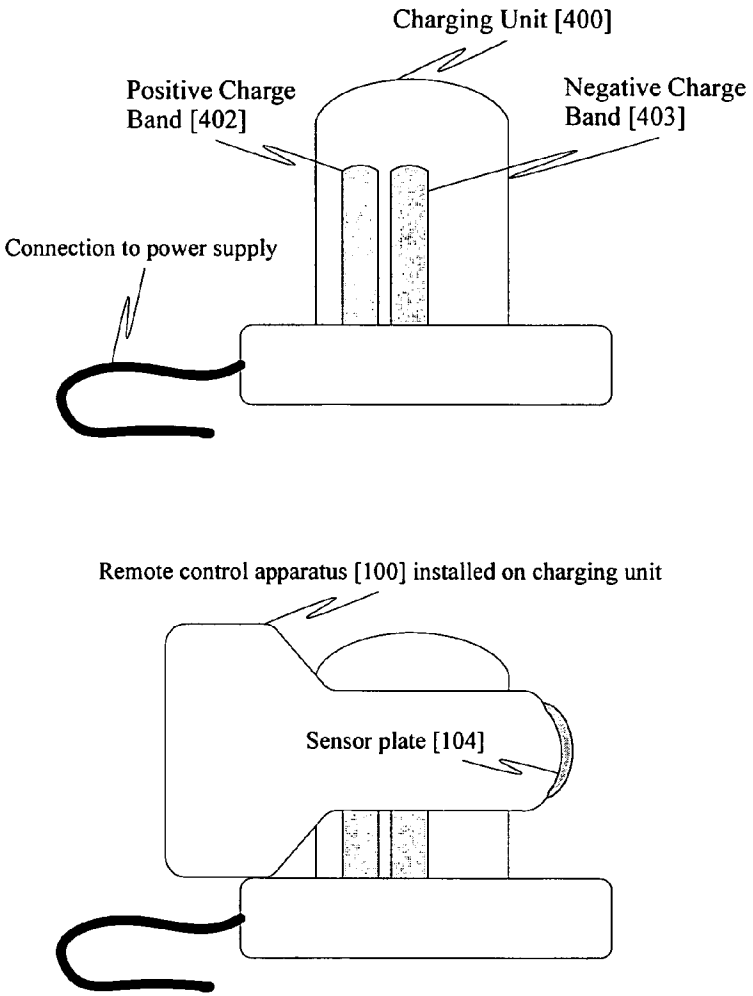
FIG. 12 illustrates an exemplary apparatus that may be used to recharge the remote control apparatus.

To facilitate the objectives of usable life and ease of use, as well as several other objectives, including post-production programming, the preferred embodiment also employs a recharging mechanism. FIG. 9*a* illustrates the preferred mode for recharging the internal battery of the remote control apparatus. It does so through aligned openings in the ring enclosure that provides access to conductive charging points 105. The charging points connect ground and positive leads to a separate charging unit 400, of which an exemplary unit is shown in FIG. 12. In the exemplary embodiment, the charging unit has a post upon which the ring slips, through the finger hole. The charging unit connects to a power source, and has positive and negative charge bands 402 and 403, respectively, aligned with the charging points. The charging bands conduct current from the power supply to the battery 101, via the charging bands and charge points.

Due to the risk inherent in recharging, where a fault in the battery can cause damage or harm, the embodiment may include a temperature sensor 186 (e.g. temperature-to-voltage converter, thermocouple, etc.), shown in FIG. 6*a*, that monitors the temperature of the battery during recharging. The embodiment may also include a battery voltage detector 185. The detector 185 may provide voltage measurements that the controller 183 might use to improve the accuracy of capacitive or other sensor readings by re-calibrating the readings responsive to battery voltage changes. The sleep mode may also be activated when the battery voltage drops below a set level. The embodiment may also provide external access to the temperature-to-voltage converter via a third access point 107 on the inner surface of the ring's band. The access point 107 may also serve a secondary purpose as an alternative programming connection (instead of the charge based programming methodology).

The exemplary charging mode does not preclude other charge or charge monitoring modes and/or methods.

Functional, Physical, and Electrical Characteristics of the Internal Circuitry

Refer to FIG. 6*a*. The IC 180 of the illustrated embodiment periodically samples the capacitance in the field of interest 191, using the CDC 181, to take capacitance readings representing modulations to the capacitance between the sensor plate 104 and the ambient system grounded elements, such as the ring-wearing finger. The IC 180 encodes this information appropriately for RF transmission and feeds it to the on-chip RF transmitter 182.

The battery 101 and the adjacent circuitry 102 constitute part of a complex of components that forms a continuous ground plane. As shown in FIG. 14*b*, this grounding complex consists of the ground plane 1011 at the base of the battery, the upper IC board 1021, the lower IC board 1022, the outer (shield) conductor (antenna) 173 of the loop structure 103, the negative charge point 105 on the underside of the ring, and the inner band 106 on the underside of the ring.

The battery 101 generates +VBattery that it conduces to the antenna 173. The ground is formed by the connectivity between the battery ground plane 1011, each of the IC boards 1021 and 1022, and the inner band 106.

The illustrated arrangement locates the battery 101 directly under the lid, and the internal circuitry 102 directly under the battery 101. This arrangement conserves space, and realizes the other grounding benefits related to the proximity with the battery. To further reduce space and realize the desired grounding effect, the two PCB substrates (upper board 1021 and lower board 1022) of the internal circuitry 102 may face each other, as shown in FIG. 14*b*.

Figure 14A:
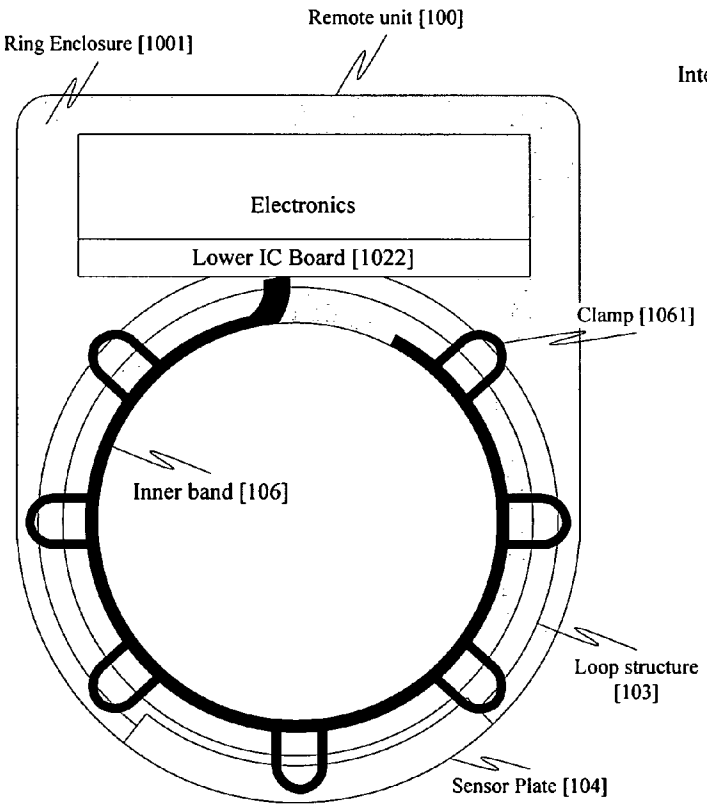
FIG. 14*a* illustrates details of the inner band assembly.

Additionally inner band 106 may provide means for the rigid attachment of components to maintain a given topology as illustrated in FIG. 14*a*.

Those skilled in the art will recognize that other arrangements of internal components may provide similar benefit.

Post-Production Programming

For the purpose of programming, updating data into, or otherwise interacting with the logic present on the internal circuitry 102 of the remote control apparatus 100, the embodiment provides a means to communicate programming instructions to the remote control apparatus, at any time during its recharge process.

Figure 13:
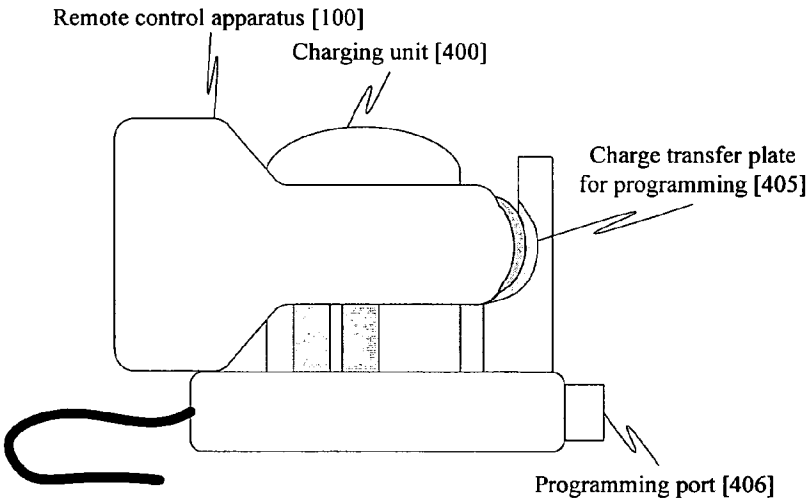
FIG. 13 illustrates a charge-based method for establishing a communications link with the internal microprocessor logic.

In an exemplary embodiment, the base unit 200 stores the programming instructions that constitute the update, and employs the charging unit 400, FIG. 13, as a means for communicating updates to the remote control apparatus 100. Specifically, the charging unit provides a programming port 406 that connects with a similar programming port 202 of the base unit 200, FIG. 15. The charging unit 400 employs a charge-based method to communicate varying voltage to the internal circuitry 102 of the remote control apparatus 100. The circuitry 102 interprets the varying voltage as a programming signal, and correspondingly affects the programming instructions stored in memory (not shown) associated with the micro-controller 183.

As shown in FIG. 13, the method of charge-based communication involves a conductive path created by the contact between the charge plate 405 of the charging unit and the sensor plate 104 of the remote control apparatus, and extended by the sensing lead 171 to the circuitry. However, the remote control is not limited to this specific connectivity for charging and/or updating the programming of the remote control apparatus.

Those skilled in the art will recognize that there are a multitude of methods for encoding the programming signal, and apparatus for generating the programming signal through the programming port of the charging unit.

Identifying and Authenticating Control Signals

To accommodate multiple performers using distinct instances of the remote control apparatus 100 in overlapping reception areas, the system employs an identification scheme that ensures that a given base (receive) unit 200 properly recognizes and responds to each remote control apparatus 100 assigned to it.

Thus, the embodiment enables a many-to-many relationship between remote control apparatus and base unit, such that the operator may configure a base unit to:

Respond to exactly one remote control apparatus; or

Respond to a plurality of remote control apparatus.

Similarly, the preferred scheme allows for a given remote control apparatus to:

Be recognized by exactly one base unit; or

Be recognized by a plurality of base units.

In the embodiment, a base unit allows only those remote control signals that correspond to the remote control apparatus assigned to it.

The system accomplishes this correlation through a repeatable identification process, in which the base unit actively tags the remote control apparatus assigned to it, or reads one or more tags already assigned to the remote control apparatus. During the Base to ring tagging process, the base unit algorithmically determines the tag with the highest probability of uniqueness, stores the tag, and imprints the tag into the memory of the remote control apparatus. Subsequent to the tagging action, the remote control apparatus encodes its tag into its control signal transmissions as the bit pattern discussed above (or a portion thereof), and the base unit will recognize the control signals emanating from that remote control apparatus.

In an exemplary embodiment, the active tagging is accomplished by setting the remote control apparatus 100 onto the charging unit 400, as is done for the exemplary procedure for programming the ring, as described above. Unlike the programming process, the tagging process is accomplished through instructions and algorithms built into the CPU 203 of the base unit.

In an exemplary embodiment, the tagging process is automatically invoked by the base unit, through the programming port 406 of the charging unit, each time the ring is placed onto the charging unit. Thus, each time a ring is set into the charging unit, for example, to recharge its battery, the base unit re-tags it and/or reads its existing tags. As noted above, the system employs both encoded messages containing data 153 (introduced in FIG. 6*a*) and the silent period between messages to convey information, where each inter-message duration 154 (FIG. 10*a*) is derived from a capacitive measure. At least a portion of the message data corresponds to the tag programmed into the remote control device 100, so that the base unit 200 can identify the particular remote control device 100 that transmitted each RF signal carrying capacitive measurement information.

In summary, the multiplicity of the relationship between remote control apparatus and base unit may be determined by the particular application of the invention.

Exemplary Receive (Base) Unit

Figure 15:
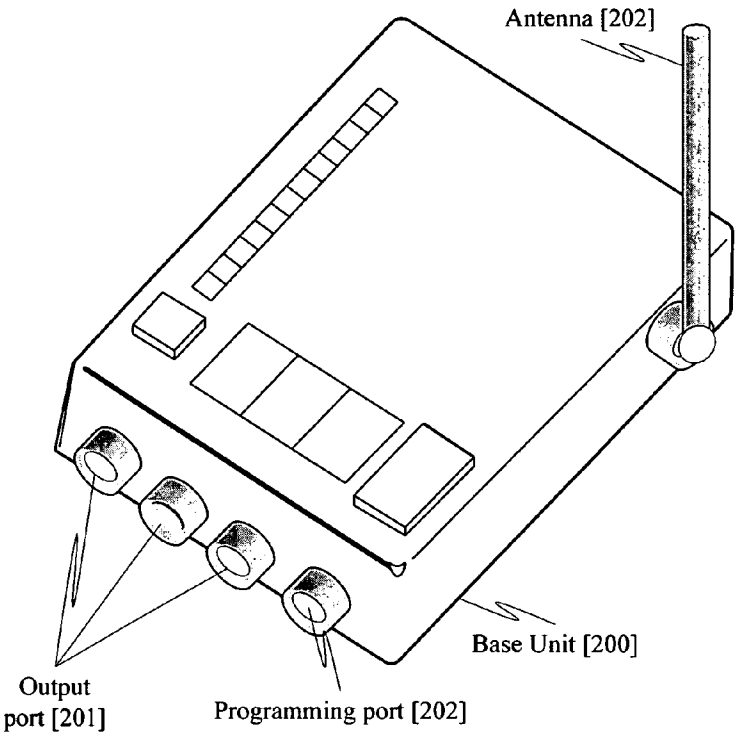
FIG. 15 illustrates an exemplary base unit.

FIG. 15 shows an exemplary receive (base) unit 200 that is part of the overall control system, to thus enable remote control of effects devices to the greatest advantage enabled by the wearable remote control device 100.

Figure 16:
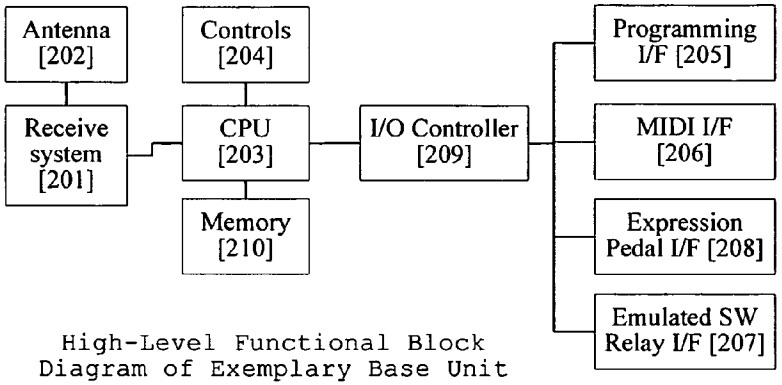
FIG. 16 is a high-level diagram of the components and functional subsystems of an exemplary receive (base) unit.

FIG. 16 is a high-level block diagram of the functional components that may be performed by such a base unit 200. The exemplary base unit is comprised of, in part, one or more RF receivers 201; one or more antennas 202; one or more microprocessors (CPU) 203; a control plane for a user interface consisting of appropriate physical controls 204 and possible associated display components; and one or more output interfaces for supplying control signals to one or more controlled devices. As mentioned earlier, the present teachings regarding wireless remote control have a wide range of applications, therefore the base unit 200 may have one or more output interfaces for supplying control signals to a variety of different types of controlled devices. In the example, the base unit 200 is configured to control audio effects type devices, for performance applications. Hence, the exemplary base unit 200 includes an interface (I/F) 205 to a external programming unit; an interface 206 to an external MIDI device; an interface 207 to an external switched relay device; an interface 208 to an external expression pedal device; an input/output controller 209 for managing the external interfaces; and memory 210 to provide persistent data storage.

The receiver 201 receives the RF signal with control information, from the remote control apparatus 100, and passes the data to the microprocessor (CPU) 203.

The CPU 203 processes the received sensor data, according to both built-in programming instructions and user-defined configuration parameters. The data, for example, is processed to recognize the tag of the remote control device 100, and the timing is processed to extract the latest measure of capacitance. The CPU 203 then drives the external effects control interfaces, at least in response to the latest measure of capacitance, according to both built-in instructions and user-defined configuration parameters.

DETAILED EXAMPLE OF THE EXEMPLARY CPU

The CPU(s) 203 of the exemplary base unit 200 is able to concurrently handle receiver input, I/O from the control plane, the input from the programming interface, and the output to the external interfaces all in real time. The exemplary CPU may employ a prioritized interrupt system that favors reception and handling of control signals from the remote control apparatus. The exemplary CPU may be programmable and enable flash updates to its programming memory. The exemplary CPU may provide an interface to persistent memory 210, for storing configuration information and related operational data.

Exemplary Process for Receiving Control Signals

Figure 17:
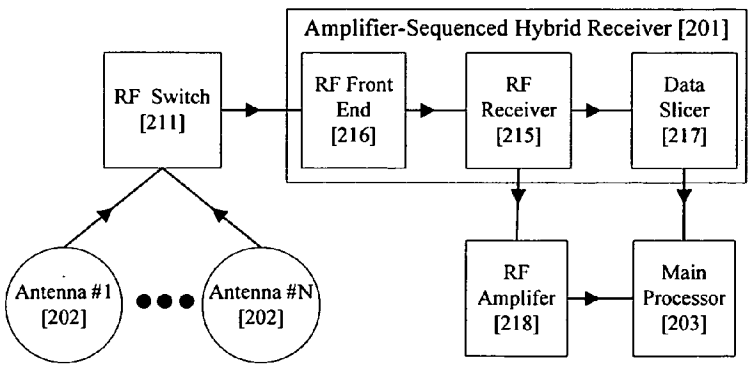
FIG. 17 is a high-level block diagram of an exemplary reception process for the Base (Receive) Unit.

FIG. 17 is a high-level block diagram of an exemplary reception process for the Base (Receive) Unit 200. In the example, the receive process within the base unit 200 may have a multiplicity of antennae 202 (for diversity), an amplifier-sequenced hybrid RF receiver 201, an RF switch 211, an RF amplifier 218, and the main processor or CPU 203.

The exemplary receive process may selectively filter the incoming RF control signal. The CPU 203 may apply an algorithm to instruct the RF switch 211 as to which of the antennae signals are used. Within the hybrid receiver 201, an RF Front End 216 may provide frequency filtering and pre-amplification. An RF receiver 215 within the hybrid receiver 201 may isolate the signal by correlating the power of the incoming pulses, as shown in FIG. 11*a*. While an amplifier 218 continuously amplifies the RF signal coming from the RF receiver, a data slicer 217 may assess the relative strength of the incoming RF signal, and notify the CPU 203 when to acknowledge input from the amplifier.

To further the objectives—including the ability for multiple operators (performers) to use the invention within an overlapping range—the exemplary receive process may validate the incoming RF signal. First, it may discriminate signals according to bit pattern, accepting only those signals that are recognizable as control signals coming from a remote control apparatus 100 of the type discussed herein. Subsequently, it may inspect the identifying tag present in the bit pattern, to ensure that the control signal emanates from a remote control apparatus 100 dedicated to the particular base unit 200. The timing of messages received from the one such control apparatus 100, that is to say the inter-message duration 154 (FIG. 10*a*) indicates the capacitive measure.

Further, as shown in FIG. 11*b*, the exemplary receive process may employ a power correlation method to enable multiplexing of multiple control signals issued simultaneously.

Those skilled in the art will recognize that a variety of RF receivers and filtering methods could be utilized to fulfill the stated functions.

Exemplary External Interfaces for Output

As mentioned earlier, the present teachings regarding wireless remote control have a wide range of applications, therefore the base unit 200 may have one or more output interfaces for supplying control signals to a variety of different types of controlled devices. In the example, the base unit 200 is configured to control audio effects type devices, for performance applications. Hence, the exemplary base unit 200 may provide one or more of each type of the following external interface (I/F) outputs to components of an electronic audio system 302: a) a MIDI output I/F 206 to devices (including musical effects and instruments) that can be controlled by MIDI messages; b) an expression pedal output I/F 208 to devices (including musical effects and instruments) that can be controlled by expression pedal inputs; c) an emulated footswitch relay output I/F 207 to devices (including musical effects, amplifiers, and instruments) that can be controlled by footswitch inputs. Other interfaces may be added as dictated by the intended application.

Exemplary Control System

The exemplary base unit 200 may provide a control system 204, through a user interface that enables the operator to configure certain operating parameters related to how the base unit 200 handles input from the remote control apparatus.

A primary user interface may consist of LEDs to indicate status, one or more textual displays to provide information and guided interaction, push buttons, knobs, and/or other manner of controls for managing and providing input to the interface.

A secondary user interface may consist of a software program loaded onto a personal computing (PC) device and an adapter that connects to a programming I/F 205 of the base unit 200. This interface 205 may enable advanced configuration of the base unit 200, to accommodate configuration options not easily supported by the primary (physical) user interface.

The Memory system 210 may enable the user to recall and apply one of a set of pre-defined configurations, persistently save a plurality of user-defined configurations, and recall and apply and user-defined configuration.

For the exemplary audio performance application, the configurable operating parameters may include, but are not limited to the following:

- Selection of interfaces to be used by the patch
- Type of footswitch operation—toggle or momentary
- MIDI channel selection
- MIDI CC number
- MIDI program change number
- Response curve to apply to MIDI CC values
- Response curve to apply to expression pedal output
- Normal or Reverse polarization of the expression pedal and MIDI CC outputs
- Range of finger motion associated with expression pedal and MIDI CC outputs
- Event triggers, based on a particular sequence of behavioral expressions, that actuate a singular or multifaceted data transformation, control signal, or combination.
- Metrics (magnitude, proportion, sensitivity, etc.) that characterize the whole or parts of a behavioral signature, such as a special zone of movement or acceleration reported by the remote control apparatus.

The user interface may also enable the user to calibrate the remote control apparatus 100 in a fashion that correlates to the user's range of finger movement. Such a calibration feature furthers the objectives by enhancing ease of use and by conforming to the performer's playing style.

Exemplary Training and Customization of the Base Unit

The exemplary base unit 200 may also enable the user to define transformations that the base unit is to perform on the sensor measurement information. The simplest form of transformation correlates the measurement received from the remote control device to user-defined values that are applied directly to the attributes of specified effects.

The system may provide a means for more complex transforms by applying customizable response curves to the sensor readings. Thus, the affects on the capacitance can be made to appear as if they occurred in a different manner, while still maintaining a rhythmic relationship to the actual performance. These manipulations could include, but are not limited to, reversing the polarity of the sensor value (akin to reversing the direction of hand movement, i.e., hi sensor value=low control signal out), temporal changes (e.g.; speeding up or slowing down the rate of change in the sensor value), and introducing steps in the effects control output signal or data.

The exemplary base unit may provide a means for a user artist to identify expressive behavioral signatures in the sensor reading resulting from a performance, selectively map these expressive behavioral signatures to an action or series of actions, and script behavioral signatures that may also be associated with one or more actions. The base unit may enable the user to persistently store and retrieve the user-defined behaviors.

As can be appreciated from the foregoing detailed description, the present remote control apparatus, charging unit and/or base station unit form a control system that supports a feature-rich and expressive means of remotely controlling devices. The system, with the exemplary remote control apparatus in the form of a finger ring, may control various devices.

In the exemplary application, the system provides nuanced control of electronic audio effects devices, in a manner that is particularly suited for performing artists. A benefit related to applications for the performing artist is that control of the effects results from performance technique, as opposed to the conventional means of a separate disjointed actuation or expression. The disclosed remote control apparatus appears to the artist as an extension of the performance. It allows performing artists to take advantage of natural hand motions that are part of their playing technique to control their effects—thus allowing them to make more fluid and intuitive expressions. The system affords the performing artists more freedom to move about and interact with their audiences during performances, due to the un-tethered, wireless communication with the base unit. Moreover, this type of remote control allows the performer to control one or more effects, typically for the audio processing, without the assistance of another party. In particular, performers who otherwise use their hands to play their instrument—such as guitarists or rhythmic vocalists—benefit by being able to apply control without negatively affecting their performing styles. The remote control apparatus can actually be operated while the performer is otherwise using the hand on which the wireless remote control apparatus is mounted. Further, guitarists (and the like) are no longer dependent on stationary floor pedals to control audio effects, while gaining a dynamic sensitivity not available in current effects controllers. Additionally, this system allows performing artists to augment their performance through sophisticated and nuanced controls mapped to behavioral expressions. As can also be appreciated, this technology provides for a variety of unconventional remote control techniques and uses related to live musical performances, including: the shared use of the remote control apparatus, which a group of performers can pass among them; and remote control of non-audio effects (such as stage lighting) linked to behavioral expressions. Importantly, this control system requires no alteration of any existing instrumentation or audio processing equipment. Further, it provides usability features including power saving modes that extend the periods of use and extend the life of the battery.

The immediately preceding discussion focused on benefits of the exemplary implementation for remote control of effects devices by performing artists. However, similar benefits may be found in applications for control of other devices and/or under circumstances beyond those of performing artists.

The examples described here employ a capacitive sensing system in the remote control apparatus (ring) 100 to detect an electrical field of its own generation immediately about the wearing finger, for example as may vary in response to the extension or flexion of the wearing finger. It uses a temporally-based charge-transfer method to resolve relative capacitance, and transmits responsive information to a base unit 200. The base unit 200 receives this information, applies transformations determined by the operator, and issues control signals to one or more connected audio effects devices, according to operator configuration.

The illustrated arrangement successfully integrates a number mutually affecting and co-dependent components in the remote control apparatus 100—the antenna, the sensor plate, the sensor lead, the battery, and the internal circuitry—in a small form factor. In so doing, the wearable remote control device 100 incorporates a coaxial-like loop structure that is contained within the band of the ring. This structure serves multiple purposes. The inner conductor serves dual purposes. One segment of its center conductor serves as a lead to connect the sensor plate to the internal circuitry, as part of the sensing system. A second segment of the center conductor provides a means for dynamically tuning the antenna. The outer conductor serves as both the loop antenna and as a shield for the center conductor. Further, because the outer conductor is biased to the battery voltage, the field about the sensor plate is extended in a focused manner that conserves the capacitive field itself.

Also, the illustrated arrangement of the internal components facilitates statically tuning the antenna to the specifications of a particular application. A related aspect of the design is the arrangement of internal components to form a continuous grounding plane that reduces interference and extends the dynamic range of the sensing system. Another related aspect of the design is the arrangement of battery, circuit boards, and an inner band assembly to provide structure support, both during and after manufacturing.

The design allows for, and the inventors realize, the possibilities and advantages of combining the capacitive sensing method with other sensor types such as accelerometers, photo sensors, Hall Effect devices, piezo devices, pressure sensors, etc. For example a secondary sensor type while perhaps not as suitable for expressive performance based control, may enhance the capacitive sensor method by providing a means for switching modes of operation associated with the capacitive sensor.

The addition of a temperature sensor 186 (e.g. temperature-to-voltage converter, thermocouple, etc.), for example, may be used to monitor temperature during battery charging to prevent damage or harm, etc. Alternatively, a temperature sensor may be used to improve the accuracy of capacitive or other sensor readings by re-calibrating the readings to temperature changes. If an additional sensor or the control is configured to provide battery voltage monitoring, such as voltage monitor 185, voltage measurements may be used to improve the accuracy of capacitive or other sensor readings by re-calibrating the readings based on battery voltage changes. It is also possible to optimize the sleep algorithms based on battery voltage conditions.

The disclosed method for communicating information from the remote control apparatus to the base unit uses both identifiable messages and the period between messages to convey meaningful information. Each inter-message duration is a derivative of a measured capacitance. The messages themselves carry all manner of information in a pulse-width-modulated encoding scheme that correlates a discrete sequence of data bits to each of a finite set of pulse widths. This encoding scheme is particularly useful for identifying and authenticating the remote control apparatus. Further, the embodiment supports multiplexed control signals, through a method that separates discrete, multiple pulse streams from a complex waveform.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A method, comprising steps of:

generating an electrical field at a location on a finger of a hand of a musician involved in a musical performance;

repeatedly measuring capacitance at a sensor plate contained in a ring worn at the location on the finger of the musician, as an indication of position of a part of the hand of the musician relative to the location of the ring on the finger, wherein each measuring of capacitance comprises:

(a) transferring charge from the sensor plate, and (b) measuring the transferred charge as a representation of the capacitance at the sensor plate, wirelessly transmitting a signal representing results of the capacitance measurements, wherein the signal representing results of the capacitance measurements indicates time required to complete each measurement of the transferred charge;

receiving the wirelessly transmitted signal; and generating a control signal for output to a controlled audio effects device processing a musical signal produced by the musician's performance, based on the results of the capacitance measurements represented by the received signal.

2. The method of claim 1, wherein the signal representing the results of the capacitance measurements indicates each measurement of the capacitance at the sensor plate.

3. The method of claim 1, wherein the step of generating the electrical field comprises applying a voltage to the sensor plate.

4. The method of claim 1, wherein the step of generating the control signal comprises generating a signal to control a standard type of audio effects device.

5. The method of claim 1, wherein the step of generating the control signal comprises generating a signal of a standard type to control processing an audio signal from a musical instrument being played by the musician by the audio effects device.

6. The method of claim 5, wherein the method steps are performed while the musician is using the hand to play the musical instrument.

7. A wireless remote control system for controlling an audio effects device processing a signal produced as part of a musical performance, comprising:

a remote control apparatus comprising:

(a) a housing configured as a ring for wearing on a finger of a hand of a musician involved in the musical performance;

(b) a sensor plate contained by the housing;

(c) circuitry contained by the housing for applying a signal to the sensor plate to generate an electrical field at a ring location on the finger of the hand of the musician, and for sensing the electrical field at the ring location as an indication of position of a part of the hand of the musician relative to the location of the ring on the finger, wherein the circuitry comprises:

(i) a capacitance-to-digital converter for repeatedly sensing charge transferred from the sensor plate, for producing a digital value representing a measurement of capacitance at the sensor plate in response to each transferred charge; and (ii) a controller; and (d) a transmitter contained by the housing and controlled by the controller, for wirelessly transmitting a signal representing a result of the sensing of the electrical field, wherein the controller controls message transmissions from the transmitter in such a manner that the durations between successive message transmissions represent times required to complete respective measurements of capacitance at the sensor plate; and a base unit, comprising:

(1) a receiver for receiving the wirelessly transmitted signal; and (2) a processor coupled to the receiver, for generating a control signal for the audio effects device, based on the results of the capacitive measurements indicated in the received signal.

8. The system of claim 7, wherein:

the signal from the transmitter comprises a signal pulse modulated with a plurality of messages containing data; and the data in one or more of the messages includes at least a tag identifying the remote control apparatus.

9. The system of claim 7, wherein:

the controller is programmable; and the remote control apparatus includes a coupling for receiving an update of programming for the controller.

10. The system of claim 7, wherein:

the processor is a programmable processor, and the base unit further comprises:

(a) memory for storing programming for the processor; and (b) an input interface coupled to the processor, for receiving programming for the processor for loading into the memory.

11. The system of claim 7, wherein the housing further contains a transmit antenna coupled to the transmitter.

12. The system of claim 7, wherein:

the housing further contains a rechargeable battery providing operating power to the circuitry and the transmitter; and the housing has a coupling, for providing a connection of the battery to a charger.

13. The system of claim 7, wherein the remote control apparatus further comprises a sensor for detecting a condition and supplying a condition responsive signal to the circuitry.

14. The system of claim 13, wherein the sensor comprises a temperature sensor for detecting temperature in relation to a battery of the remote control apparatus or a voltage detector for detecting voltage of the battery.

15. The system of claim 13, wherein the sensor comprises a sensor of a type selected from the group consisting of an accelerometer, a photo sensor, a Hall Effect detector, a piezo sensor, and a pressure sensor.

16. The system of claim 7, wherein the base unit further comprises an output interface responsive to the processor, for supplying the control signal to the controlled audio effects device.

17. The system of claim 16, wherein the output interface is configured for compatibility with and control of a standard type of audio effects device.

18. The system of claim 17, wherein the output interface comprises at least one interface selected from the group consisting of:

a Musical Instrument Digital Interface (MIDI) type output interface;

an expression pedal output interface; and an emulated footswitch relay.

* * * * *